US011383353B2

(12) United States Patent
Clifford et al.

(10) Patent No.: US 11,383,353 B2
(45) Date of Patent: Jul. 12, 2022

(54) ROTARY BRUSH WITH VIBRATION ISOLATION

(71) Applicant: Osborn, LLC, Richmond, IN (US)

(72) Inventors: Shane Clifford, Glenwood, IN (US); Zachary Small, Richmond, IN (US); Brian Keiser, Cambridge City, IN (US)

(73) Assignee: OSBORN, LLC, Richmond, IN (US)

( * ) Notice: Subject to any disclaimer, the term of this patent is extended or adjusted under 35 U.S.C. 154(b) by 885 days.

(21) Appl. No.: 16/188,266

(22) Filed: Nov. 12, 2018

(65) Prior Publication Data

US 2019/0143487 A1 May 16, 2019

Related U.S. Application Data

(60) Provisional application No. 62/584,186, filed on Nov. 10, 2017.

(51) Int. Cl.
*A46B 13/00* (2006.01)
*B24D 13/14* (2006.01)

(52) U.S. Cl.
CPC ..... *B24D 13/145* (2013.01); *A46B 13/008* (2013.01); *A46B 2200/3093* (2013.01)

(58) Field of Classification Search
CPC ..... A46B 3/10; A46B 13/008; A46B 3/16; A46B 7/08; A46B 7/10; B24D 13/10; B24D 13/145
See application file for complete search history.

(56) References Cited

U.S. PATENT DOCUMENTS

| | | | | |
|---|---|---|---|---|
| 2,480,877 A * | 9/1949 | Peterson | ..... | A46B 13/008 15/180 |
| 4,457,040 A | 7/1984 | Hettes | | |
| 5,471,695 A | 12/1995 | Aiyar | | |
| 5,507,061 A | 4/1996 | Miyazaki | | |
| 2014/0013525 A1 | 1/2014 | Zhou | | |

FOREIGN PATENT DOCUMENTS

| | | |
|---|---|---|
| EP | 0848921 | 6/1998 |

* cited by examiner

*Primary Examiner* — Shay Karls
(74) *Attorney, Agent, or Firm* — McDonald Hopkins LLC

(57) ABSTRACT

A rotary brush configured to isolate vibration during use reducing vibration at a hand-held power tool to which the brush is coupled. The brush has wires arrangeable in tufts extending from a hub sandwiched between two plates assembled to a tool coupling having an isolator therebetween. The isolator and coupling are part of a vibration-isolating assembly having a radial isolator carried by a coupling shaft located between the (i) shaft, and (ii) hub and plates preventing brush vibration from being transmitted to the tool through a coupling end of the shaft mounting the brush to the tool. The isolating assembly preferably includes an axial isolator between (i) each flange and (ii) the hubs and plates. Isolators are made of vibration dampening material and can be formed into a single isolator of one-piece unitary construction. A preferred brush is a cup brush having plates contoured to define wire supporting cups.

16 Claims, 4 Drawing Sheets

ROTARY BRUSH WITH VIBRATION ISOLATION

CROSS REFERENCE

This application claims priority under 35 U.S.C. § 119(e) in U.S. Provisional Patent Application No. 62/584,186 filed Nov. 10, 2017, the entire disclosure of which is hereby expressly incorporated herein by reference.

FIELD

The present invention is directed to a rotary abrasive implement used in material removal, surface finishing, and other abrasive applications, and is more specifically directed to a rotary abrasive brush, such as a rotary cup brush, which is configured to isolate vibration generated during abrasive material removal from an operator grasping a rotary power tool rotating the brush during abrasive surface finishing use and operation of the brush.

BACKGROUND

Rotary abrasive implements, such as in the form of grinding wheels, cutting discs, abrasive discs, rotary brushes, and the like, are used in a wide variety of material removal and surface finishing applications, including to grind, cut, deburr, descale, sand, texturize, buff and polish objects, components, surfaces and the like. Such rotary abrasive implements typically are configured for removable attachment to a rotary drive, which typically is in the form of an air or electric powered rotary tool, such as a grinder, e.g., angle grinder, straight grinder, die grinder or bench grinder, a disc cutter, a drill, or another type of rotary power tool.

In use, the rotary abrasive implement is removably attached to a rotary drive, such as a rotary power tool, during which the abrasive implement is rotated at relatively high speeds ranging anywhere from several hundred revolutions per minute (RPMs) to several thousand RPMs. In operation, the rotary power tool rotates the abrasive implement which engages a workpiece to abrasively treat the workpiece to grind it, cut it, deburr it, descale it, sand it, polish it, or even buff it. During abrasive treatment of the workpiece, a human operator either manually holds and manipulates the rotary power tool to engage the rotating abrasive implement with the workpiece or manually holds and manipulates the workpiece into engagement with the rotating abrasive implement.

During use and operation, a considerable amount of vibration can occur, which not only can lead to operator fatigue and repetitive stress injuries, but such vibration can also make it more difficult to keep the rotating abrasive implement and workpiece in uniform contact with one each other. Where vibration is so great that it interferes with that ability to maintain uniform contact between the rotating abrasive implement and the workpiece, it can result in uneven abrasive material removal. Even worse, where such vibration cannot be adequately controlled or compensated for, it can lead to chatter, which can undesirably not only damage the surface of the workpiece being abrasively treated with the rotating abrasive implement, but it also can lead to excessive premature wear of the abrasive implement or even damage the rotary power tool.

One type of rotary abrasive implement is a rotary brush, such as a radial brush, wheel brush, cup brush or end brush, which are removably attached to a handheld rotary power tool, such as a hand held grinder or rotary drill, equipped with a handle, hand grip or the like, which is manually grasped by one or more hands of the operator to operate the tool and manipulate the rotating brush into engagement with the workpiece. The brush is formed of a center disc or hub from which elongate wire tufts outwardly extend, which each have a working face formed by the free ends of the wires or bristles of the tuft which engages the workpiece and abrasively removes material from the workpiece during rotation of the brush. As the bristles or wires of the tufts of the rotating brush contact the workpiece, the tips of the bristles or wires of the tufts of the rapidly rotating brush contact the workpiece in a manner that can cut, grind, deburr, descale, sand, texturize, buff or polish the workpiece.

During use and operation, friction and impacts between the tips of the bristles or wires of the tufts of the rapidly rotating brush and the workpiece cause vibration to arise, which typically is transmitted through the brush, to the rotary power tool rotating the brush, to the handle or hand grip of the power tool, and to the hands of the operator grasping the handle or hand grip of the tool. The frequency, magnitude, and duration of the vibration can vary but can be dependent on factors such as the force with which the operator is pressing the brush into engagement with the workpiece, the roughness, contour and other characteristics of the outer surface of the workpiece engaged by the rotating brush, as well as other factors. Such vibration can not only lead to operator fatigue and repetitive stress injury, it can also undesirably accelerate brush and rotary tool wear. In addition, such vibration can not only make it more difficult to uniformly abrasively treat the workpiece with the rotating brush, but excessive vibration can lead to damaging of the surface of the workpiece, such as when chatter occurs.

What is needed is an improved rotary abrasive implement configured to reduce vibration. What is needed is an improved rotary brush configured to reduce the magnitude of vibration generated during engagement with the workpiece that is transmitted through the rotary tool to the hands of an operator grasping the handle or hand grip of the tool.

SUMMARY

The present invention is directed to a rotary abrasive implement that is configured to isolate vibration generated during abrasive material removal from being transmitted to a rotary drive that preferably is a hand-held power tool, such as a grinder or drill, so less vibration is transmitted to the hands an operator grasping a handle or hand grip of the tool. A preferred vibration isolating rotary abrasive implement of the present invention is a rotary wire brush, such as a rotary wire cup brush, having wires or bristles extending outwardly from a perforate central brush wire carrying hub that is sandwiched between two plates carried by a rotary tool coupling configured to isolate brush vibration from the rotary power tool to which the brush is attached via the coupling. The wires or bristles of the brush can be arranged into groups of wires or bristles formed into tufts attached by twisting or twist knots to the hub forming a twisted knot brush with standard twist knots, cable knots or even stringer bead knots. Such a rotary vibration isolating abrasive implement of the present invention that is a rotary vibration isolating brush advantageously experiences reduced vibration, is easier to control or manipulate during abrasive material removal, prevents chatter during abrasive surface finishing, reduces noise during abrasive material removal, increases rotary brush and rotary tool life, and can help reduce operator fatigue and repetitive stress injuries.

The rotary tool coupling is part of a vibration isolating coupling assembly configured for attachment of components of the rotary brush, including one or both plates and/or the hub, configured for releasable or removable attachment of the brush to a rotary power tool, such as a hand-held rotary power tool, e.g., grinder or drill, and configured provide vibration isolation to isolate vibration generated by rotating brush engagement with a workpiece from the rotary power tool. A preferred rotary tool coupling includes an elongate shaft configured for releasable or removable mounting to a rotary power tool like a grinder or drill, and configured to generally coaxially receive or carry one or more and preferably all of the plates and hubs, and configured to rotate at least the hub and preferably the plates and the hub substantially in unison about a longitudinally extending center axis of the shaft when rotated by the rotary power tool during rotary brush use and operation. A preferred vibration isolating coupling assembly is configured for receipt of the hubs and each one of the plates during brush assembly, configured for releasable or removable mounting of the brush to a rotary power tool, and configured to isolate vibration generated by the rotating brush during abrasive material removal from the rotary power tool to which the brush is removably mounted.

The vibration isolating coupling assembly has a vibration isolator carried by an elongate brush component mounting shaft of the rotary tool coupling having (a) a pair of brush component retaining flanges between which the hub and plates are captured during assembly, and (b) a tool coupling end configured for removable attachment of the brush to a power tool. The vibration isolator isolates generated by wires or bristles in contact with a workpiece during brush rotation that reaches the hub or plates from being transmitted to the rotary tool coupling preferably by preventing vibration from being transmitted to the shaft of the coupling. A preferred vibration isolator preferably is composed of a material that also dampens vibration thereby further configuring it as a vibration dampener that dampens vibration that is transmitted to the coupling or shaft of the coupling thereby reducing the magnitude, amplitude or intensity of vibration that is transmitted to the shaft. Such a vibration isolating coupling assembly therefore advantageously prevents and preferably also reduces vibration reaching the coupling or shaft of the coupling thereby preventing and preferably also reducing vibration reaching an operator grasping a handle or handgrip of a rotary power tool attached by the coupling to the brush.

The vibration isolator isolates the plates, hub, and wires or bristles of the brush from the rotary tool coupling including by spacing the plates and hub from the rotary tool coupling. In a preferred vibration isolating coupling assembly, the vibration isolator spaces the plates and hub from rotary tool coupling preventing direct contact between (i) the plates and hub, and (ii) the coupling. In one such preferred vibration isolating coupling embodiment, the vibration isolator is configured to space the plates and hub from the shaft of the coupling in a manner that maintains space therebetween during abrasive material removal use and operation of the brush. By maintaining space between the (i) shaft of the coupling, and (ii) the plates and hub, direct contact is prevented between the (i) shaft of the coupling, and (ii) the plates and hub, thereby preventing direct transmission of vibration from one or more or all of the plates and hub to the coupling shaft. Preventing direct contact therebetween advantageously prevents and preferably also reduces vibration generated during rotary brush use and operation that is transmitted through the coupling shaft to the rotary tool rotatively driving the brush.

The vibration isolator is composed of a tough and resilient material that can be a compressible and non-metallic material that is configured to isolate vibration generated by contact with wires or bristles of the brush during abrasive material removal during brush rotation preventing at least some vibration from being transmitted to the rotary tool coupling. A preferred vibration isolator is composed of a tough and resilient material that preferably is nonmetallic and which can be compressible with the vibration isolator configured to isolate the shaft of the rotary tool coupling from the plates and hub helping prevent vibration generated during contact via wires or bristles of the brush engaging a workpiece being abrasively treated with the brush from being transmitted by the plates or hub to the shaft. The vibration isolator is made of an elastomer or elastomeric material. A preferred vibration isolator can be made of rubber, neoprene, silicone, viscoelastic urethane polymer, urethane, nylon, styrene, styrene elastomer, acrylic or another type of suitable elastomeric material.

One preferred vibration isolator is composed of a tough and resilient material that preferably is nonmetallic and which can also be compressible with the vibration isolator configured to not only isolate (i) the plates and hub from (ii) the coupling shaft but also is configured to dampen vibration actually transmitted to the shaft from hub or either plate advantageously reducing the amplitude, magnitude or intensity of vibration reaching one or both hands of an operator grasping a rotary power tool rotating the brush during abrasive material removal use and operation. Such a preferred vibration-dampening vibration isolator preferably is made of an elastomer or elastomeric material. A preferred vibration-damping isolator can be made of rubber, neoprene, silicone, viscoelastic urethane polymer, urethane, nylon, styrene, styrene elastomer, acrylic or another type of suitable elastomeric material.

A preferred embodiment a vibration coupling assembly includes at least one of a radial vibration isolator and an axial vibration isolator and preferably includes both a radial vibration isolator and axial isolator. While a vibration isolator composed of both a radial isolator and an axial isolator can be formed of a single vibration isolator of one-piece and unitary construction, the vibration isolator can be configured as a vibration isolator arrangement or vibration isolator assembly composed of a radial vibration isolator and an axial vibration isolator that are separate components.

Where the vibration isolating tool coupling assembly is equipped with a radial vibration isolator, the radial vibration isolator is configured to radially isolate (i) at least one of the plates and hub from (ii) the shaft of the coupling including by radially spacing (i) at least one of the plates and hub from (ii) the coupling shaft. A preferred radial vibration isolator is configured to isolate vibration transmission between opposed radial surfaces of at least one of the plates and hub from the coupling shaft, and preferably is configured to isolate vibration transmission between opposed radial surfaces of each one of the plates and hub from the coupling shaft.

Where equipped with a radial vibration isolator, the radial vibration isolator is disposed between (i) the shaft of the rotary tool coupling, and (ii) the hub and/or the plates and configured to provide radial vibration isolation therebetween helping prevent brush vibration from being transmitted via the wires, hub or plates in or along a radial direction to the coupling shaft thereby isolating such vibration from the rotary power tool to which the brush is mounted by the coupling. This advantageously prevents vibration generated by the rotating brush during abrasive material removal engagement with the workpiece from being transmitted to one or both hands of an operator using the rotary power tool rotating the brush. In a preferred embodiment equipped with a radial vibration isolator, the radial isolator is located between (i) the hub and the plates, and (ii) the coupling shaft providing radial vibration isolation therebetween that helps prevent transmission of brush vibration to the rotary power tool to which the brush is attached.

A preferred radial vibration isolator is a tubular radial vibration isolator that is received, e.g., telescoped, over at least part of the shaft of the coupling that carries the hub and plates and configured with the tubular vibration isolator serving as a vibration isolating spacer that spaces (i) the shaft from (ii) the hub and plates preventing direct contact therebetween. Where the plates and hub have non-circular shaft receiving openings of a complementary shape or configuration to a corresponding non-circular outer peripheral contour or cross-section of the coupling shaft keying the plates and hub for rotation in unison with the shaft, the tubular radiation vibration isolator is configured to conform to the non-circular outer peripheral contour or cross-sectional shape of the coupling shaft. Where a preferred embodiment of a vibration isolating rotary power tool coupling assembly has a coupling shaft of hexagonal cross-section, and the plates and hubs have complementarily hexagonally shaped shaft-receiving openings, the radial vibration isolator either is formed to have a hexagonal shape or cross section or is configured to be resiliently deformable, e.g., stretchable, to conform to the hexagonal cross section of shape of the coupling shaft when telescoped over the shaft.

Where the vibration isolating tool coupling assembly is equipped with an axial vibration isolator, the axial vibration isolator is configured to axially isolate (i) at least one of the plates and hub from (ii) the shaft of the coupling including by axially spacing (i) at least one of the plates and hub from (ii) the coupling shaft. A preferred vibration isolating tool coupling assembly is equipped with a plurality of axial vibration isolators with each axial vibration isolator is configured to isolate vibration transmission between opposed axial surfaces of at least one of the plates and the hub from the coupling shaft, and preferably configured to isolate vibration transmission between opposed axial surfaces of each one of the plates and hub from the coupling shaft. One such preferred vibration isolating coupling assembly has axial isolators located between an axial surface of the coupling shaft and an axial surface of a respective one of the plates. If desired, an axial isolator can also be disposed between an axial surface of one or both of the plates and an adjacent axial surface of the hub.

Where equipped with an axial vibration isolator, the vibration isolating coupling assembly includes at least one axial vibration isolator disposed between (i) one of the brush component retainer flanges of the coupling shaft, and (ii) one of the plates and the hub. Where equipped with an axial vibration isolator, the vibration isolating coupling assembly includes at least one axial vibration isolator located between (i) an axial surface of one of the brush component retainer flanges of the coupling shaft, and (ii) an opposed axial surface of one of the plates and the hub.

One preferred vibration isolating coupling assembly has at least one axial vibration isolator located between (i) one of the flanges of the coupling shaft, and (ii) an adjacent one of the plates with the at least one axial vibration isolator located between (i) an axial surface of one of the coupling shaft flanges, and (ii) a corresponding opposed axial flange of an adjacent respective one of the plates. Another such preferred vibration isolation coupling assembly is configured with a plurality of axial vibration isolators (i) having one of the axial isolators positioned between one of the flanges of the coupling shaft and one of the plates, and (ii) having another one of the axial isolators positioned between the other one of the flanges of the coupling shaft and the other one of the plates. The vibration isolation coupling assembly can be further configured to also have an axial vibration isolator between each one of the plates and the hub. In one preferred vibration isolation coupling assembly, there is an axial vibration isolator between each flange of the coupling shaft and one of the plates adjacent the flange and there also is an axial vibration isolator between each plate and the hub.

A vibration isolating rotary brush of the present invention has a vibration isolating coupling assembly having a radial vibration isolator carried by the coupling shaft that is disposed between both flanges and which can extend to one or both flanges, and at least one axial vibration isolator disposed between one of the flanges and one of the plates. A preferred vibration isolating brush of the present invention has a vibration isolating coupling assembly with a radial vibration isolator telescopically carried by the coupling shaft extending between the flanges of the shaft, and a plurality of axial vibration isolators with one axial vibration isolator between one of the coupling shaft flanges and one of the plates and another axial vibration isolator between the other one of the coupling shaft flanges and the other one of the plates. The one axial vibration isolator is disposed in abutment with the one of the coupling shaft flanges and in abutment with the one of the plates. The other one of the axial vibration isolators is disposed in abutment with the other one of the coupling shaft flanges and in abutment with the other one of the plates.

In a preferred vibration isolating brush of the present invention, the brush is a rotary wire cup brush with the pair of the plates being generally concave and three-dimensionally contoured to form coaxially nested generally frusto-conical cups defining a brush wire, tuft or bristle guide channel along which the wires, bristles or tufts anchored to the hub radially and axially outwardly extends. Such a rotary wire cup brush can have bristles formed of wires of generally straight or crimped construction or bristles formed of wires braided and/or twisted including twisted knotted into brush wire tufts anchored by the knots to the hub. Vibration isolation of the cup brush provided by radial and/or axial vibration isolators of the vibration isolating rotary tool coupling assembly advantageously helps isolate and block transmission of vibration generated during abrasive material removing contact between the rotating brush and workpiece from being transmitted to an operator manually holding the rotary power tool to which the brush is removably coupled. The radial and/or axial vibration isolators preferably are also configured respectively as radial and/or axial vibration dampeners that absorb and thereby reduce the magnitude, amplitude or intensity of vibration actually transmitted from the brush to the tool reducing vibration encountered by the operator during brush use and operation. Such a rotary vibration isolating cup brush advantageously possesses longer life, experiences reduced vibration and chatter during use, reduces vibration encountered by an operator using a rotary tool to which the brush attached, reduces brush wear, reduces tool wear, increases brush life, increases tool life, reduces vibration-induced operator fatigue, and helps prevent repetitive stress injuries.

These and other objects, features and advantages of this invention will become apparent from the following more detailed description of the invention and accompanying drawings.

DRAWING DESCRIPTION

One or more preferred exemplary embodiments of the invention are illustrated in the accompanying drawings in which like reference numerals represent like parts throughout and in which.

Figure 1:
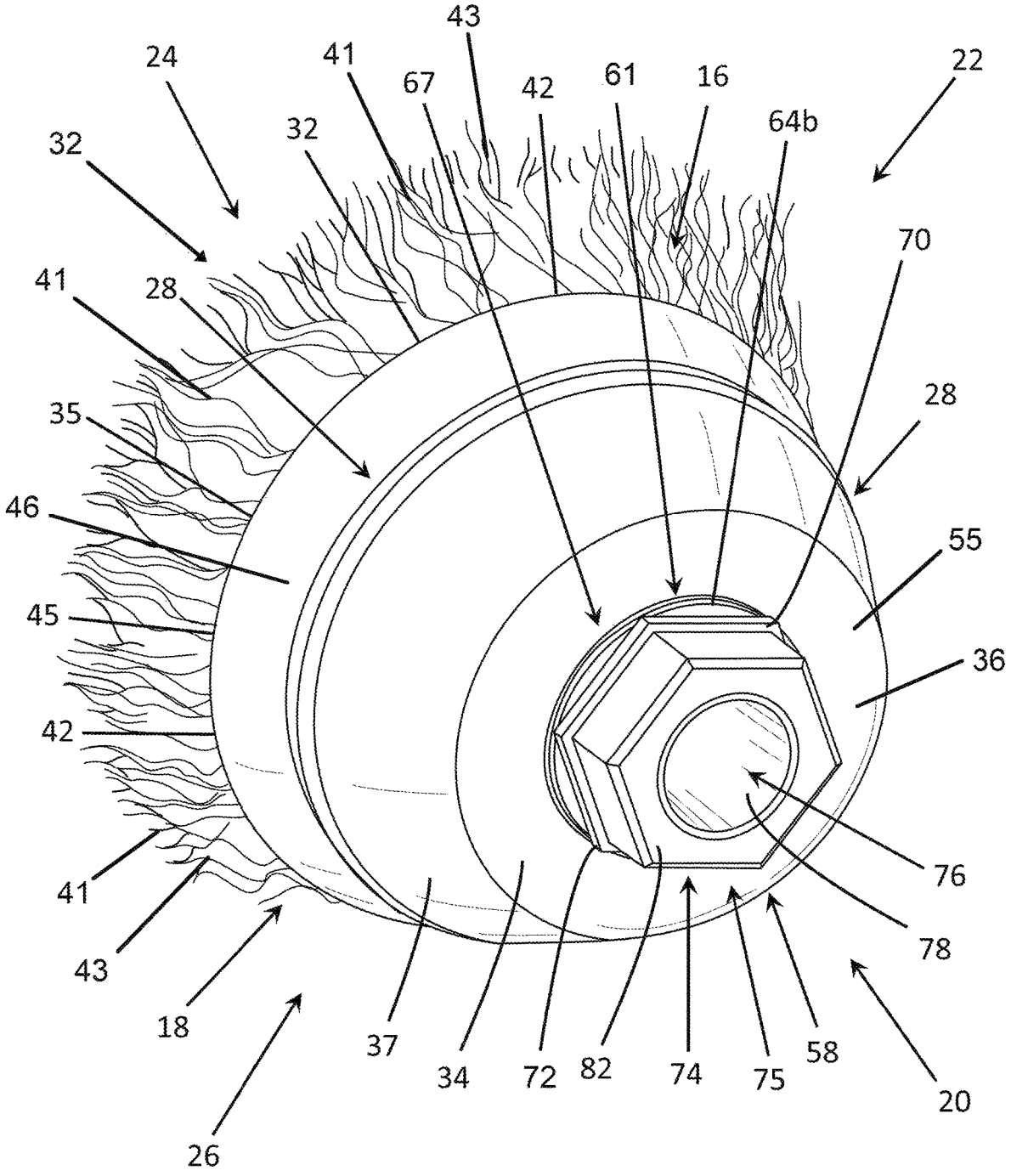
FIG. 1 is a bottom rear perspective view of a rotary wire brush of the present invention that is a rotary wire cup brush of vibration isolating construction having an annular brush fill composed of wires.

Before explaining one or more embodiments of the invention in detail, it is to be understood that the invention is not limited in its application to the details of construction and the arrangement of the components set forth in the following description or illustrated in any appended drawings. The invention is capable of other embodiments, which can be practiced or carried out in various ways. Also, it is to be understood that the phraseology and terminology employed herein is for the purpose of description and should not be regarded as limiting.

DETAILED DESCRIPTION

With reference to FIGS. 1-4, the present invention is directed to a rotary abrasive implement 16 that is a rotary wire brush 18 that more preferably is a rotary wire cup brush 20 of vibration-isolating construction used for abrasively removing material from a workpiece (not shown) in performing surface finishing treatment of the workpiece. Such a rotary abrasive implement 16 that is a rotary brush 18 that more preferably is a rotary cup brush 20 of vibration-isolating construction is removably mounted to a rotary abrasive implement drive (not shown), such as a hand-held rotary drive, like a hand-held rotary power tool (also not shown), e.g., a grinder, such as an angle grinder, straight grinder, die grinder, or another hand-held grinder, a drill, or another type of hand-held power tool but can also be used with fixed rotary abrasive implement drives, such as a bench grinder or drill press. Such rotary drives can be electrically powered, pneumatically powered, or even powered in another manner, such as powered via an internal combustion engine. Such a vibration-isolating rotary abrasive implement 16 that is a vibration-isolating rotary brush 18 that more preferably is a vibration-isolating rotary cup brush 20 of the present invention is well suited for a wide variety of abrasive material removal and surface finishing applications, such as, paint removal, rust removal, descaling, deburring, blending, sanding, weld surface preparation, cleaning of finished welds, e.g., slag removal, polishing, buffing, and other types of abrasive material removal, abrasive surface treatment, and abrasive surface finishing applications.

A vibration isolating rotary abrasive implement 16, vibration isolating rotary brush 18, preferably vibration isolating rotary cup brush 20, of the present invention is configured to provide vibration isolation between the workpiece and the rotary drive to which the abrasive implement 16, brush 18, and cup brush 20 is attached. Where the rotary drive is hand held, the rotary abrasive implement 16, rotary brush 18, preferably cup brush 20, of the present invention is configured to provide vibration isolation between the workpiece and the rotary drive thereby preventing at least some vibration generated at the workpiece from being transmitted to the handle or hand-grip of the drive. As a result of the vibration isolating construction causing an operator to experience less vibration at the handle or hand-grip of the drive, more continuous contact between the abrasive implement 16, brush 18, preferably cup brush 20, is maintained advantageously more uniformly finishing the surface of the workpiece. In addition, operator fatigue is reduced, noise can be reduced, and both the useful life of the abrasive implement 16, brush 18, preferably cup brush 20 and the drive are increased. Such an abrasive implement 16, brush 18, preferably cup brush 20 of the present invention preferably also is of vibration-damping construction in that the implement 16, brush 18, preferably cup brush 20, reduces the magnitude of vibration generated at the workpiece transmitted through the implement 16, brush 18, preferably cup brush 20, to the hand-held rotary drive and to the operator.

Where the rotary drive is a fixed rotary drive, the abrasive implement 16, brush 18, preferably cup brush 20, of the present invention also is configured to provide vibration isolation between the workpiece and the fixed rotary drive thereby preventing at least some vibration generated at the workpiece to be transmitted to the fixed rotary drive. Reduced vibration not only can increase the useful life of the drive and the abrasive implement 16, brush 18, preferably cup brush 20, but it can make any workpiece that is manipulated by hand into engagement with the abrasive implement 16, brush 18, preferably cup brush 20, easier to manually urge into contact therewith helping producing a more uniform surface finish. Such an abrasive implement 16, brush 18, preferably cup brush 20 of the present invention preferably also is of vibration-damping construction in that the abrasive implement 16, brush 18, preferably cup brush 20, reduces the magnitude of vibration generated at the workpiece that are transmitted through the abrasive implement 16, brush 18, preferably cup brush 20, to the fixed rotary drive.

With continued reference to FIGS. 1-4, a preferred vibrationally-isolating rotary abrasive implement 16 is a vibrationally-isolating rotary wire brush 18 that is a vibrationally-isolating rotary wire cup brush 20 which preferably is a vibrationally-isolating and vibrationally-damping rotary wire cup brush 22. In a preferred embodiment, the vibration-isolating rotary abrasive implement 16 is a vibration-isolating rotary wire brush 18 that is a vibration-isolating rotary wire cup brush 20 which preferably is a vibration-isolating, vibration-damping, and vibration-absorbing rotary wire cup brush 24 of the present invention configured to provide vibration isolation between the workpiece and the rotary drive, e.g., rotary power tool while also reducing the magnitude of vibration. In another preferred embodiment, the vibration-isolating rotary abrasive implement 16 is a vibration-isolating rotary brush 18 that is a vibration-isolating cup brush 20 which preferably is a vibration-isolating, vibration-damping, vibration-absorbing and shock absorbing rotary wire cup brush 26 of the present invention configured not only to provide vibration isolation between the workpiece and the rotary drive, e.g., rotary power tool but also configured to reduce the magnitude of vibration encountered as well as configured to absorb shock loads encountered during abrasive material removal.

Such a vibration-isolating rotary abrasive implement 16 of the present invention that preferably is a cup brush 20 configured to provide vibration isolation advantageously not only isolates at least some of the rotary cup brush vibration from the hands of an operator holding a hand-held rotary power tool rotating the cup brush preventing at least some vibration from reaching the operator, but preferably also dampens at least some of the rotary cup brush vibration further while reducing the magnitude or amplitude of other vibration that actually does reach the operator. As a result, such a vibration isolating and preferably vibration dampening cup brush 20 of the present invention thereby advantageously reduces and preferably minimizes operator fatigue while also reducing and minimizing the number, amount, severity and magnitude of repetitive stress related problems and injuries known to operators of such hand-held rotary brushes. As discussed in more detail below, a cup brush 20 of vibration and/or shock-loading dampened and/or isolating construction of the present invention advantageously significantly reduces operator fatigue by reducing the magnitude of vibration and/or shock loads transmitted from the rotating cup brush 20 to an operator manually holding a hand-held rotary brush drive, e.g., hand-held rotary power tool, during abrasive material removal in finishing or treating a surface with the cup brush 20.

Figure 2:
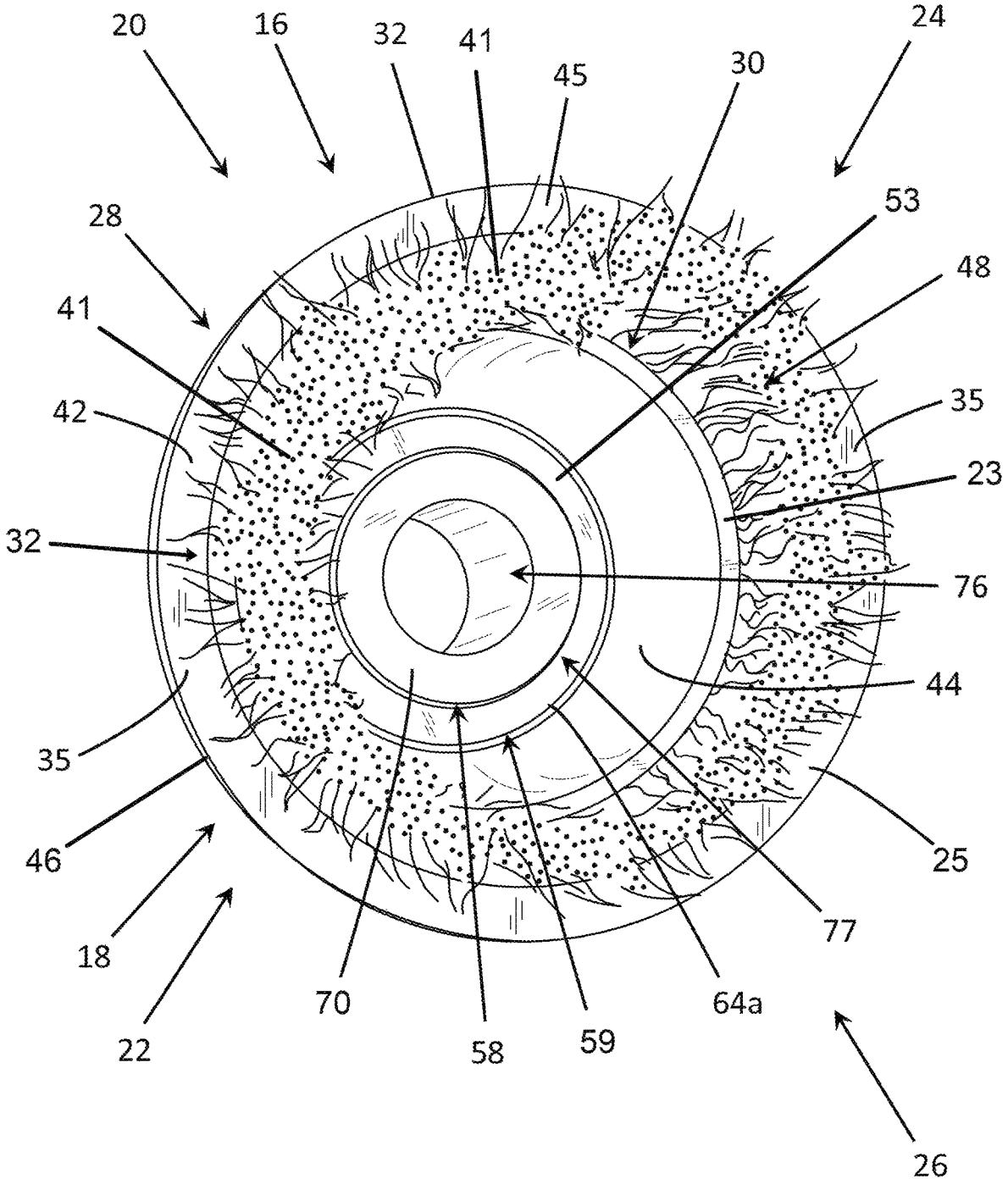
FIG. 2 is a top front perspective view of the vibration-isolating rotary cup brush of FIG. 1.

With reference to FIGS. 1-2, a vibration-isolating rotary wire brush 18 of the present invention has at least one plate 23 and/or 25 disposed alongside and in operable cooperation with a brush wire anchoring perforate center hub 38 from which brush wires 41 arranged to form an annular brush fill 32 outwardly extends with at least one plate 23 and/or 25 configured to support or help support the fill 32 during brush use by at least one plate 23 and/or 25 supporting wires 41 of the fill 32 during brush use. A preferred vibration-isolating rotary brush 18 of the invention has a pair of plates 23, 25 disposed in operable cooperation with the hub 38 by being operatively connected to the hub 38 such that the plates 23, 25 and hub 38 rotate in unison during rotation of the brush 18 by a rotary power tool during abrasive material removal using the brush 18. In a preferred rotary brush embodiment, the hub 38 is sandwiched between at least a portion of the pair of plates 23, 25. Where the brush 18 is equipped with a pair of plates 23, 25, the plates 23, 25 are arranged to be located on opposite sides of the fill 32 and configured by being positioned to provide support to the fill 32 preferably by supporting at least a portion of wires 41 of the fill 32 that form bristles 43 of the brush 18.

Where the brush 18 is a rotary cup brush 20, the cup brush 20 has at least one plate 23 and/or 25 that is at least one three-dimensionally contoured or three-dimensionally shaped plate 27 and/or 29 disposed in operable cooperation with the hub 38 and configured to rotate substantially in unison with the hub 38 during brush operation and which is further configured to support bristles 43 formed of the portion of the wires 41 of the fill 32 that extend outwardly away from the hub 38 toward a workpiece abrasively engaged by the brush during brush operation. Where the brush 18 is a rotary wire cup brush 20 equipped with a pair of plates, the cup brush 20 is configured with the plates 23, 25 having respective central sections 53, 55 sandwiching the hub 38, such as in the manner best shown in FIG. 4. Where the brush 18 is a rotary wire cup brush 20 equipped with a pair of plates, the cup brush 20 is configured with the plates 23, 25 being inner and outer plates 23, 25, with the inner plate 23 being disposed interiorly or inwardly of the wire 41 of the fill 32 and the outer plate 25 being disposed exteriorly or outwardly of the wire 41 of the fill 32. In a preferred embodiment, the rotary wire brush 18 is a rotary wire cup brush 20 equipped with a pair of plates 23, 25 that are three dimensionally shaped that respectively have (a) centrally disposed sections 53, 55, e.g., bottom walls 34, 36, overlapping and sandwiching the hub 38 therebetween, and (b) generally annular sidewalls 44, 46 disposed respectively on opposite sides of the fill 32 of the brush preferably contacting and supporting bristles 43 or wires 41 of the fill 32 of the brush.

In a preferred embodiment, a vibration-isolating cup brush 20 of the invention has a pair of three-dimensionally contoured or shaped plates 27, 29 which preferably are generally convex or convexly-shaped respectively defining inner and outer brush wire supporting cups 28, 30 disposed on opposite sides of the fill 32. Where the cup brush 20' is made with wires 41 twisted into brush wire tufts 42 like the cup brush 20' shown in FIG. 3, the inner and outer supporting cups 28, 30 are disposed on opposite sides of the twisted wire, e.g., twisted tuft or twisted knot, tufts 42 that form the fill 32' of the brush 20'. Each brush wire supporting cup 28 and/or 30 provides support to the wires 41 and/or tufts 42 of the fill 32 or 32' during abrasive engagement with a workpiece being abrasively treated by the brush 20 or 20' helping maintain better more uniform abrasive brush bristle contact with the workpiece. Each brush wire supporting cup 28 and/or 30 provides support to the wires 41 and/or tufts 42 of the fill 32 or 32' in a manner that also helps prevent bristles 43 or wires 41 of the brush 20 or 20' from bending, crinkling, splaying or otherwise undesirably deflecting during abrasive engagement with the workpiece during brush cup use and operation.

As best shown in FIGS. 1-2, a preferred rotary cup brush 20 of the present invention has a smaller diameter inner brush wire, brush wire filament, or brush bristle supporting cup 28 generally coaxially nested within a larger diameter outer brush wire, brush wire filament, or brush bristle supporting cup 30 and has an abrasive bristled brush fill 32 formed of elongate brush wires 41 extending outwardly from a brush bristle guide channel 48 formed by and between the cups 28 and 30. As is best shown in FIG. 2, the wires 41 of the abrasively-bristled brush fill 32 extend outwardly along the channel 48 beyond the channel 48 defined between the sidewalls 44 and 46 of the cups 28 and 30 with the exposed bristles 43 having tips 45 at their free end forming an abrasive workpiece engaging working face 35 that contacts the workpiece during abrasive material removal using the brush. Where the cup brush 20' is formed of brush tufts 42, like the cup brush 20' of FIG. 3, the workpiece face 35' is formed by the tips 45 of the bristles 43 composed of wires 41 twisted together to form the tufts 42 twist knot anchored to the hub 38. The inner and our brush cups 28 and 30 are of substantially rigid, metallic or metal, e.g., steel, construction, and bracket the radially inner and outer boundaries of the wires of the abrasively-bristled annular brush fill 32 with the brush cup sidewalls 44, 46 providing support wires 42 and tufts 42 at least along one quarter the length and preferably along at least forty percent the length of the wires 41, bristles 43, or tufts 42 of the cup brush 20 or 20' during cup brush operation.

Figure 3:
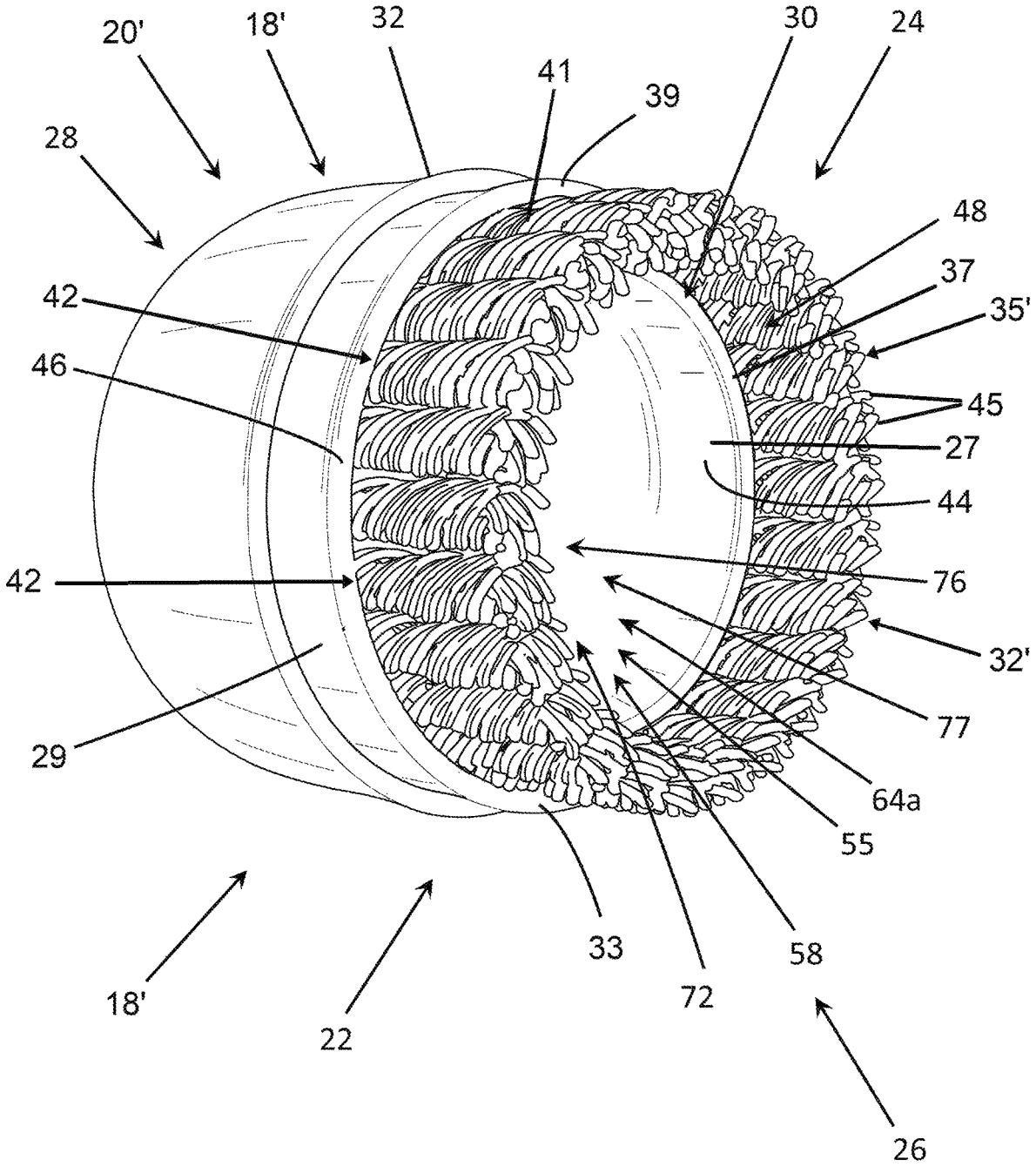
FIG. 3 is a right front perspective view of another preferred embodiment of a vibration-isolating rotary cup brush of the present invention having a brush fill composed of twisted wire tufts.

With specific additional reference to FIG. 3, a rotary wire cup brush 20' that is of twisted tuft or twisted knot construction can also be configured to be a vibrationally isolating and preferably also a vibrationally damping or vibration absorbing cup brush 20' in accordance with the invention. Such a cup brush 20' has all of the vibrationally isolating components shown in FIGS. 1-2 and 4 and discussed elsewhere herein but can differ in other respects therefrom, including by being of twisted tuft or twisted knot construction. Such a twisted tuft or twisted knot rotary wire cup brush 20' has elongate wires 41 arranged in elongate brush wire tufts 42 that extend radially outwardly of the hub 38 of the brush 20'. In a preferred embodiment, the tufts 42 are of twisted knot construction formed by groups of at least a plurality of pairs, i.e., at least three, elongate wires 41 looped through respective openings 40 in the hub 38 and twisted together to form knots that anchor the tufts 42 to the hub 38. The tufts 42 can be anchored to the hub 38 with standard twist knots, cable knots, or even stringer bead knots and the wires 42 that form each tuft 42 twisted together at least one-half and preferably at least two-thirds the length of the wires 41 and tufts 42. As with the wire fill cup brush 20 shown in FIGS. 1 and 2, the twisted knot cup brush 20' of FIG. 3 has inner and outer cups 28 and 30 of generally cylindrical or frustoconical construction having their respective brush cup sidewalls 44 and 46 concentrically bracketing or bounding opposite sides of the tufts 42 helping to support the tufts 42 when in abrasive material removing engagement with a workpiece. The sidewalls 44 and 46 of the cups 28 and 30 respectively provide radially inner support and radially outer support to the tufts 42 of the brush 20' that form the generally cylindrical or annular fill 32' of the brush 20'. The inner and outer cups 28 and 30 of the brush 20' are of substantially rigid, metallic or metal, e.g., steel, construction, and bound or encompass, e.g., radially or concentrically encircle, the tufts 42 that make up the fill 32' of the brush 20' thereby providing support to the tufts 42 of the fill 32' as well as to individual wires 41 that make up the tufts 42 along at least one-third the length of the wires 41 or tufts 42, preferably along at least forty percent the length of the wires 41 or tufts 42, and more preferably along at least one half the length of the wires 42 or tufts 42 during abrasive material removal using the brush 20'

Figure 4:
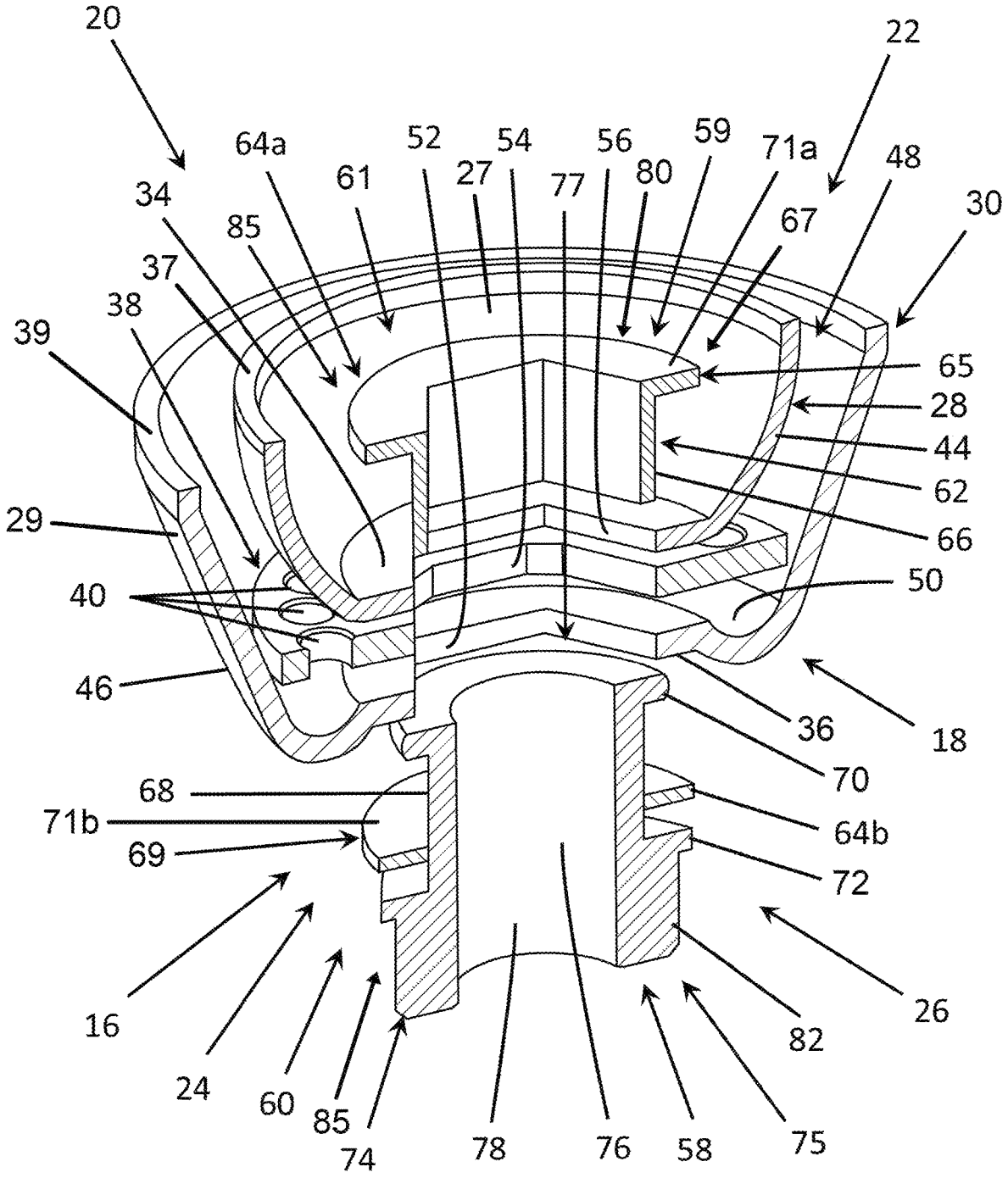
FIG. 4 is a partially cutaway exploded view of the vibration-isolating rotary cup brush of the present invention illustrating in more detail the location and arrangement of vibration isolation within the brush.

As shown in FIG. 4, the inner cup 28 of a vibration isolating rotary brush 20 or 20' of the invention has a generally flat or planar and generally circular cup bottom wall 34 from which a generally cylindrical and preferably frustoconical cup sidewall 44 generally axially outwardly extends. The outer cup 30 of the brush 20 also has a generally flat or planar and generally circular cup bottom wall 36 from which a generally cylindrical and preferably frustoconical cup sidewall 46 generally axially outwardly extends. Each cup 28 and 30 is respectively made of a three-dimensionally formed plate 27 and 29, such as a metal plate, e.g., steel plate, which preferably is generally concavely shaped or formed producing such a generally concave cup-shaped three-dimensionally formed plate 27 and 29 respectively having a bottom wall 34 and 36 from which corresponding extends a corresponding generally frustoconical cup sidewall 44 and 46. The respective cup bottom walls 34 and 36 overlie one another sandwiching a perforate generally disc-shaped substantially rigid brush wire anchoring hub 36 therebetween. The brush wire anchor hub 38 has circumferentially spaced apart generally circular brush-wire receiving holes 40 about its periphery from which elongate brush wires 41 outwardly extend. Where twisted like the wires 41 of the twisted tuft or twisted knot cup brush 20' shown in FIG. 3, the elongate brush wires 41 extend through a corresponding one of the holes 40 in the hub 38 and are twisted to form tufts 42 and twist knots that anchor the tufts 42 to the hub 38. Where straight or crimped like the wires 41 that form the fill 32 of the cup brush 20 shown in FIGS. 1 and 2, the wires 41 can extend through the holes 40 in the hub 38 and be wrapped around part of the hub 38 to anchor the wires 41 thereto or can be fixed, attached or otherwise anchored to the hub 38 in a different manner. Although not clearly shown in FIGS. 1 and 2, the abrasively bristled brush fill 32 is formed of a plurality of pairs of the brush wire tufts 42 projecting axially from the brush bristle or filament guide channel 48 outwardly beyond outer peripheral edges 37, 39 of the cups 28, 30.

With continued reference to FIG. 4, each one of the nested cups 28, 30 of a vibration isolating rotary brush 20 or 20' of the present invention have a respective sidewall 44, 46 nested generally coaxial within one another defining the brush wire or filament channel 48 therebetween from which the wire tufts 42 of the bristled brush 32 extend. The cup sidewalls 44 and 46 support at least a portion of the elongate wires 41 or bristles 43 of the cup brush fill 32, including where the fill 32' is formed of tufts 42 of such wires 41 or bristles 43. Such wires 41, bristles 43 and/or tufts 42 of the fill 32 or 32' of the brush 20 or 20' extends generally in an axial direction and generally parallel with the inner cup sidewall 44 bounding and supporting the radially innermost portion of the wires 41, bristles 43 or tufts 42. Such wires 41, bristles 43 and/or tufts 42 of the fill 32 or 32' of the brush 20 or 20' extends generally in an axial direction and generally parallel with the outer cup sidewall 46 bounding and supporting the radially outermost portion of the wires 41, bristles 43 or tufts 42. As also shown in FIG. 4, the bottom wall 36 of the outer cup 30 preferably is configured with a recessed annular well 50 for accommodating wires 41 or bristles 43 that make up the fill 32 of the brush 20 including where the wires 41 or bristles 43 are twisted into tufts 42 that that extend generally downwardly and outwardly from corresponding holes 40 in the hub 38.

In such a finished or assembled vibration isolating and/or vibrationally-damped rotary brush 20 of the present invention, the brush wire hub 38 is sandwiched between the cup bottoms 34 and 36 and preferably operatively connected together by an elongate generally centrally disposed tubular rotary tool coupling 58, which preferably is generally cylindrical, for rotation substantially in unison about a central rotational axis of the brush 20 or 20' by a hand-held rotary drive during use and operation of the brush 20 or 20'. Each one of the cups 28, 30 and the brush wire anchor hub 38 is formed with a coupling mount, preferably in the form of generally coaxially aligned hexagonal openings 52, 54, and 56 formed respectively in cups 28, 30 and hub 38, which are each configured for axially receiving part of the tubular rotary tool coupling 58, which preferably has a generally hexagonal exterior cross-sectional shape. The generally hexagonal exterior cross-sectional shape of the tubular rotary tool coupling 58 is substantially complementary in shape and size to or with the corresponding hexagonal openings 52, 54 and 56 respectively formed in the cups 28, 30 and hub 38 which are substantially aligned with one another when the tubular rotary tool coupling 58 is inserted into and through the openings 52, 54 and 56 during brush assembly. When the tubular rotary tool coupling 58 is inserted through the hexagonal openings 52, 54 and 56 in the cups 28, 30 and hub 38, the cups 28, 54 and the hub 38 are keyed to the coupling 58 for rotational in unison with the coupling 58 when the coupling 58 attaches the brush 20 or 20' to a rotary power tool like a hand-held grinder or hand-held drill. The rotary tool coupling 58 shown in FIG. 4 is not only configured to enable releasable or removable mounting or attachment of the cup brush 20 or 20' to such a rotary power tool, the brush cups 28, 30 and hub 38 are generally coaxially carried thereby with the coupling 58 being generally centrally disposed relative thereto with a central longitudinally extending axis extending along its lengthwise or longitudinal extent substantially coaxial defining an axis of rotation of the brush 20 or 20' when the brush 20 or 20' is mounted by the coupling 58 to a rotary power tool.

With continued reference to FIG. 4, a vibrationally isolating and/or vibrationally dampening rotary brush 20 or 20' of the present invention has a vibration isolator 59 that vibrationally isolates the coupling 58 from at least one of the brush wire hub 38 and cups 28 and/or 30, which isolates the coupling 58 from at least a plurality of the brush wire hub 38 and cups 28 and/or 30, and preferably which isolates the coupling 58 from each one of the brush wire hub 38 and cups 28 and/or 30. The vibration isolator 59 preferably also is a vibration dampener 61 configured such that (a) vibration of or from at least one of the brush wire hub 38, including vibration of or from brush wire tufts 42 contacting or engaging the surface undergoing abrasive surface treatment, and/or cups 28 and/or 30 is dampened during or before being transmitted to coupling 58, (b) vibration of or from at least a plurality of the hub 38, including vibration of or from brush wire tufts 42 contacting or engaging the surface undergoing abrasive surface treatment, and/or cups 28 and/or 30 is dampened during or before being transmitted to coupling 58, and (c) vibration of or from each one of the hub 38, including vibration of or from brush wire tufts 42 contacting or engaging the surface undergoing abrasive surface treatment, and cups 28 and 30 is dampened during or before being transmitted to coupling 58 there preventing at least some vibration from being transmitted to one or both hands of the operator holding the rotary power tool that is rotating the cup brush 20, and preferably also reducing the strength or intensity of vibration actually reaching one or both hands of the operator holding the rotary power tool that is rotating cup brush 20.

In a preferred rotary cup brush embodiment, the vibration isolator 59 isolates and preferably also dampens at least the hub 38 from the coupling 58 thereby isolating vibration generated by or arising due to abrasive contact between the surface being abrasively treated with the rotating cup brush 20 or 20' by or from tips 45 of wires 41 or bristles 43 of the fill 32 of the brush 20 or 20 coming into contact with the surface being abrasively treated thereby preventing at least some of the vibration from being transmitted to the hands of an operator grasping the rotary power tool rotating the brush 20 or 20'. In at least one such preferred rotary cup brush embodiment, the vibration isolator 59 also is configured to be a vibration dampener 61 that dampens, absorbs and/or reduces the amplitude, strength or intensity of such rotary brush vibrations generated by or arising from abrasive contact of the face 35 or 35' of the rotating brush 20 or 20' with the workpiece being abrasively treated thereby reducing the amplitude, strength or intensity of any vibrations not isolated by the vibration isolator 59 which are transmitted to an operator holding the rotary power tool to which the brush 20 or 20' is attached. Where the vibration isolator 59 also is configured with vibration dampening characteristics so as to be a vibration dampener 61, it preferably also is configured to alter and preferably reduce the frequency of vibrations generated by or arising from contact of the tips 45 of the wires 41 or bristles 42 of the abrasive face 35 or 35' of the brush 20 or 20' with the workpiece during rotation of the brush 20 or 20' by the rotary power tool. A preferred vibration isolating cup brush 20 or 20' of the present invention is equipped with a vibration isolator 59 that also provides vibration dampening such that it is thereby also configured as a vibration dampener 61 to both prevent vibrations generated at the brush 20 or 20' during abrasive material removal from reaching an operator manually grasping the rotary power tool to which the brush 20 or 20' is attached, and also dampen or absorb vibration thereby reducing the magnitude, amplitude or intensity of vibrations generated at the brush 20 or 20' during abrasive material removal that reaches the operator manually holding on to the rotary power tool to which the brush 20 or 20' is attached.

With continued reference to FIG. 4, the rotary tool coupling 58 of a preferred embodiment of a vibrationally isolated or vibrationally isolating rotary brush 20 or 20' of the invention can be and preferably is of vibrationally isolating and/or vibrationally damped construction that vibrationally isolates and/or dampens rotary cup brush vibration during contact of the wires 41 or bristles 43 of the rotating brush 20 or 20' with the surface being treated during abrasive material removal thereby reducing, minimizing and preferably preventing transmission of rotary brush vibration via the coupling 58 to one or both hands of an operator manually grasping the hand-held tool rotatively mounted to the brush 20 via such a vibrationally isolated and/or damped coupling 58. While the present invention contemplates a vibrational isolating and/damped coupling 58, where the vibration isolator 59 and/or dampener 61 is integrally formed with or constructed as an integral part of the coupling 58, e.g., where the isolator 59 and/or dampener 61 and coupling 58 are formed as a one-piece unit, a preferred vibration isolating and/or damped rotary cup brush 20 or 20' of the present invention is constructed with a vibration isolating coupling assembly 80 of the present invention that also is a vibration dampening coupling assembly 85, which includes one or both of a vibration isolator 59 and a vibration dampener 61, such as depicted in FIG. 4 and disclosed in more detail below.

Such a vibration isolating and/or vibration damped rotary brush 20 of the present invention has such a vibration isolating coupling assembly 80 and preferably also is or includes such a vibration dampening coupling assembly 85 formed of coupling 58 disposed in operable cooperation with at least one vibration isolator 59 and/or at least one vibration dampener 61 disposed between the coupling 58 and the other components of the brush 20, including hub 38, and cups 28 and 30. Each isolator 59 and/or each dampener 61 of a vibration isolating and/or vibration dampening rotary cup brush 20 or 20' of the present invention is made of a vibration isolating material and/or damping material, e.g., vibration absorbing material, which preferably is an elastomer, an elastomeric material, or another type of suitable compressible and resilient material that can also be or include a viscoelastic material having suitable vibration isolating, vibration damping, and/or vibration absorbing characteristics. Examples of suitable vibration isolating and/or vibration damping materials include one or more of a rubber, e.g., natural and/or synthetic rubber, including silicone rubber, butyl rubber, neoprene rubber, or another type of suitable rubber. Other suitable vibration isolating and/or vibration dampening materials include nylon, polypropylene, a polyether based polyurethane, polytetrafluoroethylene (PTFE), polyvinylchloride, a fluoropolymer elastomer, viscoelastic polymers, and combinations and/or composites thereof that can be of multilayered and/or multicomponent construction.

The vibration isolator 59 of a vibration isolating rotary cup brush 20 or 20' of the present invention can be and preferably is in the form of a vibration isolating assembly 60 formed of at least one radial vibration isolator 62 of tubular construction and which is disposed between radially opposing surfaces of (i) the rotary power tool coupling 58, and (ii) the hub 38 and cups 28, 30 of the brush 20 or 20' during assembly of the brush 20 or 20'. In a preferred embodiment, each vibration isolator 59 of a rotary cup brush 20 or 20' of the invention preferably is in the form of a vibration isolating assembly 60 formed of (a) at least one radial vibration isolator 62 of tubular construction and which is disposed between radially opposing surfaces of (i) the rotary power tool coupling 58, and (ii) the hub 38 and cups 28, 30 of the brush 20 or 20 when the brush 20 or 20' is assembled with the coupling 58, and (b) at least one axial vibration, preferably a plurality of spaced apart axial vibration isolators 64*a* and 64*b*, disposed between axially opposing surfaces (i) of the coupling 58, and (ii) of at least one and preferably at least a plurality of the cups 28, 30 and hub 38, when the brush 20 is assembled using the coupling 58. In a preferred embodiment, the radial vibration isolator 62 is configured to also provide vibration dampening or vibration absorption, and each axial vibration isolator 64*a*, 64*b* also is configured to provide vibration dampening or vibration absorption. As shown in FIG. 4, a preferred rotary cup brush 20 or 20' constructed in accordance with the present invention has at least one radial vibration isolator 62 and at least one axial vibration isolator, preferably a plurality of spaced apart axial vibration isolators 64*a* and/or 64*b*. As shown in FIG. 4, radial vibration isolator 62 is tubular and preferably elongate and generally cylindrical and each axial vibration isolator 64*a*, 64*b* is annular or generally disc-shaped. As depicted in FIG. 4, the axial vibration isolators 64*a* and 64*b* are carried by the elongate tubular rotary power tool coupling 58 and spaced apart from one another by or along the coupling 58. The axial vibration isolators 64*a* and 64*b* are spaced apart along the coupling 58 and generally coaxial with the coupling 58. The axial vibration isolators 64*a* and 64*b* preferably are also generally coaxial with each other. Radial vibration isolator 62 preferably is configured with vibration dampening or vibration absorbing characteristics thereby imparting vibration dampening or vibration absorbing to the isolator 62. Each axial vibration isolator 64*a*, 64*b* preferably also is configured with vibration dampening or vibration absorbing characteristics thereby imparting vibration dampening or vibration absorbing to each axial isolator 64*a*, 64*b*.

In a presently preferred embodiment of a vibration isolating rotary brush of the present invention, a vibrational isolating and/or vibrational dampening rotary cup brush 20 or 20' of the present invention is constructed with (a) at least at least one radial vibration isolator and/or radial vibration dampener 62 advantageously providing radial vibration isolation and/or radial vibration damping at or along at least one radial location within the assembled brush 20 or 20', and (b) a pair of axial vibration isolators and/or axial vibration dampeners 64*a* and 64*b* with the pair of axial vibration isolators and/or axial vibration dampeners 64*a* and 64*b* being axially spaced apart from one another within the assembled brush 20 or 20' thereby advantageously providing axial vibration isolation and/or axial vibration dampening at a pair of axially spaced apart locations within the assembled brush 20 or 20'. The at least one radial vibration isolator and/or radial vibration dampener 62 and each one of the axial vibration isolators and/or axial vibration dampeners 64*a* and 64*b* advantageously not only isolates vibration but also isolates shocks, jolts, impacts and the like generated, encountered or arising at the abrasive brush face 35 or 35' during abrasive surface finishing with the rotating brush 20 or 20' but also advantageously absorbs such vibrations, shocks, jolts, impacts, and the like generated, encountered or arising at the abrasive brush face 35 or 25' during abrasive surface finishing by reducing the intensity, magnitude, amplitude or intensity of such vibrations, shocks, jolts, impacts, and the like generated, encountered or arising at the abrasive brush face 35 or 25' during abrasive surface finishing. Such a rotary cup brush 20 or 20' of the present invention preferably has at least one radial vibration isolator that isolates at least some vibration, shocks, jolts, impacts and the like produced by abrasive workpiece engagement of the abrasive face 35 or 35' of the wire, bristled or tufted fill 32 or 32' of the rotating brush 20 or 20' during abrasive surface treatment from being transmitted to hands of an operator using a hand-held rotary power too to which the brush 20 or 20' is attached. Where a rotary cup brush 20 or 20' constructed in accordance with the present invention is equipped with at least one such radial vibration isolator, the radial vibration isolator 62 preferably is in the form of a vibration and/or shock isolating tube 66 that can be and which preferably also is a vibration and/or shock dampening or absorbing tube 66 having the construction, arrangement and configuration in accordance with that shown in FIG. 4 and described in more detail elsewhere herein.

Where constructed with a tubular radial vibration isolator 62 in the form of a radial vibration isolating tube 66 that can be a generally cylindrical vibration isolating tube 66, the vibration isolating tube 66 is disposed between (i) the rotary power tool coupling 58, and (ii) the cups 28, 30 and the hub 38, with the vibration isolating tube 66 having a cross-section substantially complementary to or with the coupling receiving or coupling mounting openings 52, 54 and 56 formed respectively in the cups 28, 30 and hub 38. In a preferred embodiment, the vibration isolating tube 66 has a generally hexagonal cross section so as to be telescoped or received over the generally hexagonal exterior of the coupling 58 locating the vibration isolating tube 66 between (i) the coupling 58 and (ii) the cups 28, 30 and hub 38 configuring the vibration isolation tube 66 to provide vibration isolation between the (i) the coupling 58, and (ii) the cups 28, 30, and the hub 38 during rotary brush operation. In other words, the vibration isolating tube 66 is configured to isolate vibrations arising in or encountered by the hub 38 and/or cups 28, 30 from the coupling 58 during rotary brush operation thereby preventing at least some vibration arising or encountered by the hub 38 and/or cups 28, 30 from being transmitted to the coupling 58. A preferred embodiment of the vibration isolation tube 66 is configured to dampen or absorb vibration thereby reducing the magnitude or intensity of any vibration that actually is transmitted from the hub 38 and/or cups 28, 30 to the coupling 58 and the hand-held rotary power tool connected by the coupling 58 to the brush 20 or 20'.

In one such preferred embodiment, the vibration isolation tube 66 has a generally hexagonal cross section so as to be received in and/or extend through the hexagonal openings 52, 54 and 56 respectively formed in the cups 28, 30 and the hub 38 configuring the vibration isolation tube 66 to be located between (i) the coupling 58, and (ii) the cups 28, 30, and the hub 38 such that the vibration isolation tube 66 provides vibration isolation between the i) the coupling 58, and (ii) the cups 28, 30, and the hub 38 during rotary brush operation. In other words, the vibration isolation tube 66 is configured to isolative vibrations arising in or encountered by the hub 38 and/or cups 28, 30 from the coupling 58 during rotary brush operation. A preferred embodiment of the vibration isolation tube 66 is configured to dampen or absorb vibration thereby reducing the magnitude or intensity of any vibration that actually is transmitted from the hub 38 and/or cups 28, 30 across or through the tube 66 to the coupling 58 and the hand-held rotary power tool connect to the brush 20 or 20' by the coupling 58.

As also shown in FIG. 4, the vibration isolating tube 66 is elongate with the tube 66 disposed between (i) inner peripheral edges of corresponding portions of the respective cups 28, 30 and hub 38 that define the respective coupling-receiving openings 52, 54 and 56 formed therein, and (ii) a rotary tool coupling shaft 68 of the rotary power tool coupling 58 to which the cups 28, 30 and the hub 38 are attached during brush assembly. The coupling shaft 68 preferably is elongate, can be generally cylindrical, but which preferably has a non-circular cross-section or cross-sectional shape which is substantially complementary to or with substantially complementary non-circular openings formed respectively in the cups 28, 30 and hub 38. When the cups 28, 30 and hub 38 are assembled with the non-circular shaft 68 received through the non-circular openings in the cups 28, 30 and hub 38, rotation of the shaft 68 by the rotary power tool to which the shaft 68 is coupled causes the cups 28, 30 and hub 38 to rotate in unison with the rotating shaft 68. The vibration isolating tube 66 can also be formed to have a non-circular cross-section substantially complementary with the non-circular cross-section of the shaft 68 so that the tube 66 can be telescoped over part of the shaft 68. If desired, the vibration isolating tube 66 generally cylindrical and flexible so as to conform to the non-circular cross-sectional exterior shape of the shaft 68 when the tube 66 is telescoped over the shaft 68. A preferred shaft 68 has a generally hexagonal cross-section or hexagonal exterior cross-sectional shape, the openings in the cups 28, 30 and hub 38 are hexagonal, and the tube 66 can be and preferably also is of a hexagonal shape, all for the cups 28, 30, hub 38 and tube 66 to be telescopically received by the shaft 68 with the tube 66. When the cups 28, 30, hub 38 and tube 66 are telescoped over or telescopically receive the shaft 68, the tube 66 preferably is disposed between (i) the shaft 68, and (ii) the cups 28, 30 and hub 38 providing vibration isolation therebetween.

When the vibration isolating rotary cup brush 20 or 20' is assembled, the vibration isolating tube 66 radially isolates the coupling 58 from at least one of, preferably at least a plurality of, and more preferably all of the cups 28, 30 and hub 38 by the tube 66 being made of a resilient vibration isolating material and disposed between the coupling 58 and at least one of, preferably at least a plurality of, and more preferably all of the cups 28, 30 and hub 38 thereby preventing the coupling 58 from coming into contact in or along a radial direction with at least one of, preferably at least a plurality of, and more preferably all of the cups 28, 30 and hub 38. In a preferred embodiment, the vibration isolating tube 66 is made of a tough and resilient vibration isolating material, preferably a suitable elastomer or elastomeric material, and located between (i) the coupling 58, and (ii) the cups 28, 30 and hub 38, providing vibration isolation between the (i) the coupling 58, and (ii) the cups 28, 30 and hub 38 by the tube 66 preventing the (i) the coupling 58, from coming into contact with any one of the (ii) the cups 28, 30 and hub 38 during rotary brush operation.

In a preferred embodiment of the vibration isolating rotary brush 20 or 20' of the invention, the vibration isolating tube 66 radially vibrationally isolates the shaft 68 of the coupling 58 from the cups 28, 30 and hub 38 by being substantially coaxially carried by the shaft 68 and preferably telescoped over at least part of the shaft 68 thereby locating the tube 66 radially between the shaft 68 and each one of the cups 28, 30 and the hub 38 thereby preventing direct contact therebetween during use of the rotary cup brush 20 or 20' during abrasive material removal of or from a workpiece surface during surface treatment, e.g., surface finishing, of the workpiece. By being disposed therebetween and preventing direct contact therebetween, the tube 66 is a radial vibration isolator, e.g., radial vibration isolating tube 66, by isolating at least some vibration arising in the hub 38 generated by the wires 41 of the fill 32 of the rotating brush 20 or 20' abrasively removing material of or from the workpiece surface being treated by the rotating brush 20 or 20'. By providing such vibration isolation, at least some of the vibration generated by or produced from the wires 41 of the abrasive face 35 or 35' of the fill 32 or 32' of the brush abrasively contacting the surface being finished is prevented from being transmitted to the shaft 68 of the coupling 58 used to mount the brush 20 to a hand-held rotary power tool manually held and operated by a human operator. Preventing via such isolation by tube 66 of at least some of vibration generated during surface finishing with rotating brush 20 or 20' from being transmitted to one or both hands of the operator grasping the rotary brush drive rotating the brush 20 or 20' advantageously reduces and preferably minimizes operator fatigue, reduces and preferably prevents hand and forearm strain, and/or helps reduce, minimize and preferably substantially completely prevent one or more other repetitive stress related injuries often experienced by rotary brush operators. In addition, such a radial vibration isolating tube 66 also prevents transmission to one or both hands of the operator of at least some of the shocks, jolts, impacts, and the like generated, produced or otherwise encountered during or by contact of brush wires of the bristled brush 32 of the rotating brush 20 with the surface being abrasively treated or finished therewith further reducing and preferably minimizing operator fatigue, reducing and preferably also helping prevent hand and forearm strains, and/or helping reduce, minimize and preferably substantially completely prevent one or more other repetitive stress related injuries often experienced by such rotary cup brush operators.

In a preferred vibration isolating rotary brush of the present invention, the vibration isolating tube 66 also is configured to provide vibration dampening such that the vibration isolating tube 66 also is configured as a radial vibration dampener thereby providing a radial vibration dampening tube 67 that is disposed radially between the coupling 58, preferably between its shaft 68, and at least one, preferably at least a plurality, and more preferably each one of the respective inner edges of cups 28, 30 and hub 38 that defining corresponding openings 52, 54 and 56 respectively formed therein thereby not only providing vibration isolation, such as in accordance with that discussed in the preceding paragraph above, but vibration dampening and vibration absorption that reduces the magnitude or amplitude of at least some of the vibration, shocks, jolts, impacts, and the like caused by contact of the bristled brush 32 with the surface being abrasively treated or finished being transmitted to one or both hands of a person operating the hand-held rotary power tool to which the rotary brush 20 or 20' is coupled. Such a vibration dampening tube 66 not only provides such vibration and shock or impact load or force isolation, but preferably thereby also is of a dampening construction by being configured to provide vibration dampening tube 67 that reduces the magnitude of vibration, shocks, jolts, impacts and the like produced by contact of the brush wires 41 or bristles 43 of the abrasive face 35 or 35' of the brush fill 32 or 32' of the brush 20 or 20 with the surface being treated or finished that are actually transmitted radially from the wires 41 or bristles 43 and 38 to the shaft 68 of the rotary power tool coupling 58 to one or both hands of an operator holding the hand-held rotary power tool rotating the brush 20 or 20' during abrasive surface finishing or treatment. Such a vibration dampening tube 67 preferably absorbs vibration, shocks, jolts, impacts and the like encountered during such abrasive surface finishing or treatment using rotary brush 20 or 20' of the invention thereby reducing the magnitude of vibration, shocks, jolts, impacts and the like which are actually transmitted from the brush 20 or 20' to the rotary power tool used to rotate the brush 20 or 20' in turn thereby advantageously reducing the magnitude of the vibration, shocks, jolts, impacts and the like transmitted to one or both hands of the operator manually holding the rotary power tool. Reducing via dampening or absorption by vibration dampening tube 67 of the magnitude of at least some of vibration, shocks, jolts, impacts and the like generated during surface finishing with rotating brush 20 or 20' transmitted to one or both hands of the operator grasping the rotary power tool rotating the brush 20 or 20' even further reduces and preferably minimizes operator fatigue, even further reduces and preferably prevents hand and forearm strain, and/or even further helps reduce, minimize and preferably substantially completely prevent one or more other repetitive stress related injuries often experienced by such rotary brush operators.

A vibration isolating rotary brush 20 or 20' of the present invention also has at least one axial vibration isolator 64*a* and/or 64*b* that isolates, preferably axially isolates, at least some vibration, shocks, jolts, impacts and the like produced, encountered or experienced by wires 41, bristles 43 and/or hub 38 of the rotating brush 20 or 20' from at least part of the coupling 58, preferably from at least part of the shaft 68 of the coupling 58, during abrasive surface treatment thereby advantageously preventing at least some of the vibration, shocks, jolts, impacts and the like from being transmitted to the hands of an operator holding and using the rotary power tool to which the brush 20 is mounted. Doing so advantageously reduces, preferably minimizes, and more preferably helps prevent operator stress, strain, and fatigue, including with respect to hand-related strains, stresses, inflammation, other injuries and the like. The vibration isolating brush 20 or 20' of the present invention preferably has at least one axial vibration isolator 64*a* and/or 64*b* that also is configured as a vibration dampener 71*a* and/or 71*b*, which in addition to providing vibration isolation, also dampens at least some vibration, shocks, jolts, impacts and the like produced, encountered or experienced by the wires 41 or bristles 43 and/or hub 38 of the rotating brush 20 or 20' from at least part of the coupling 58, preferably from at least part of the shaft 68, during abrasive surface treatment by reducing the magnitude or amplitude of the vibration, shocks, jolts, impacts and the like actually transmitted to the hands of an operator holding and using the rotary power tool to which the brush 20 is mounted. Doing so advantageously further reduces, preferably even further minimizes, and/or more preferably even further helps prevent operator stress, strain, and fatigue including with respect to hand-related strains, stresses, inflammation, other injuries and the like.

Where equipped with one or more axial vibration isolators 64*a* and/or 64*b* and/or axial vibration dampeners 71*a* and/or 71*b*, at least one of the axial vibration isolators 64*a* and/or 64*b* and/or axial vibration dampeners 71*a* and/or 71*b* of the rotary brush 20 or 20' of the invention is disposed axially between (a) one portion of the coupling 58 disposed at or adjacent an end of the coupling 58 releasably mounted to hand-held rotary power tool, e.g., grinder, drill, etc., and one portion of at least one of the cups 28 and/or 30 and/or the hub 38 disposed adjacent thereof, and/or (b) another portion of the coupling 58 disposed at or adjacent the opposite end of the coupling 58, and another portion of at least one of the cups 28 and/or 30 and/or the hub 38 of the brush 20 or 20' disposed adjacent thereof. Each one of the axial vibration isolators 64*a* and/or 64*b* and/or axial vibration dampeners 71*a* and/or 71*b* of the rotary brush 20 or 20' of the invention is positioned between an axial surface of the coupling 58 and an axial surface of an adjacent one of the cups 28 and/or 30 and/or the hub 38. Each one of the axial vibration isolators 64*a* and/or 64*b* and/or axial vibration dampeners 71*a* and/or 71*b* of the rotary brush 20 or 20' of the invention is positioned between an axial surface of the coupling 58 and an opposing axial surface of an adjacent one of the cups 28 and/or 30.

Where equipped with one or more axial vibration isolators 64*a* and/or 64*b* and/or axial vibration dampeners 71*a* and/or 71*b*, at least one of the axial vibration isolators 64*a* and/or 64*b* and/or axial vibration dampeners 71*a* and/or 71*b* is disposed axially between (a) one of the cups 28, e.g., inner cup 28, and an adjacent first or upper annular brush cup or hub retainer flange 70 formed integrally of part of, carried by, or in operable cooperation with the shaft 68 of the coupling 58 disposed at or adjacent a brush component assembly end 77 of the coupling 58, and/or (b) another one of the cups 30, e.g., outer cup 30, and a second or lower brush cup or hub retainer flange 72 formed integrally of part of, carried by, or in operable cooperation with the coupling 58 located at or adjacent a free end or power tool coupling end 75 configured for removable attachment to a hand-held rotary power tool. Each one of the axial vibration isolators 64*a* and/or 64*b* and/or axial vibration dampeners 71*a* and/or 71*b* of the rotary brush 20 or 20' of the invention is located axially between an axial surface of one of the flanges 70 or 72 and an axial surface of an adjacent one of the cups 28 and 30. Each one of the axial vibration isolators 64*a* and/or 64*b* and/or axial vibration dampeners 71*a* and/or 71*b* of the rotary brush 20 or 20' of the invention is located axially between an axial surface of an adjacent flange 70 or 72 of the coupling 58 and an opposing axial surface of an adjacent one of the cups 28 and 30.

A preferred vibration isolating rotary brush 20 or 20' of the present invention is equipped with a plurality of axial vibration isolators 64*a*, 64*b* having (a) one annular upper vibration isolator 64*a* located between (i) an annular cup and hub retainer flange 70 of the coupling shaft 68, and (ii) an adjacent one of the cups 28, and (b) another annular lower vibration isolator 64*b* located between (i) an annular tool coupling flange 72 of the shaft 68, and (ii) an adjacent one of the cups 30. One such preferred vibration isolating rotary brush 20 or 20' of the invention includes a pair of axial vibration isolators 64*a*, 64*b* having (a) one annular upper vibration isolator 64*a* located between (i) an axial surface of an annular cup and hub retainer flange 70, and (ii) an opposed axial surface of an one of the cups 28, and (b) another annular lower vibration isolator 64*b* located between (i) an axial surface of an annular tool coupling flange 72, and (ii) an opposed axial surface of the other one of the cups 30.

In one preferred embodiment, the cup brush 20 or 20' is equipped with both (a) an annular upper axial isolator 64*a* and/or axial dampener 71*a* disposed between (i) the annular cup brush component assembly flange 70 of the shaft 68 of the coupling 58 disposed at or adjacent an upper end of the coupling 58, e.g., at or adjacent brush cup engaging end 77 of the coupling 58, and (ii) the bottom wall 34 of the inner cup 28 of the brush 20 or 20', and (b) an annular lower axial isolator 64*b* and/or axial dampener 71*b* disposed between (i) the tool coupling end 75 and brush cup engaging end 77 of the shaft 68 of the coupling 58, and (ii) the bottom wall 36 of the outer cup 30 of the brush 20 or 20'. A preferred cup brush 20 or 20' is equipped with both (a) an annular upper axial isolator 64*a* and/or axial dampener 71*a* located between (i) the annular cup and hub retainer flange 70 of the shaft 68 of the coupling 58 located at or adjacent an upper end of the coupling 58, e.g., at or adjacent brush cup engaging end 77 of the coupling 58, and (ii) the bottom wall 34 of the inner cup 38, and (b) an annular lower axial isolator 64*b* and/or axial dampener 71*b* located between (i) the coupling end flange 72 at the tool coupling end 75 of the shaft 68 of the coupling 58 and (ii) the bottom wall 36 of the outer cup 30.

Where equipped with an upper axial isolator 64*a* and/or upper axial dampener 71*a*, the upper axial isolator 64*a* and/or upper axial dampener 71*a* is captured between the upper brush component assembly flange 70 and the bottom wall 34 of the inner cup 28. The brush 20 or 20' is assembled with the flange 70 overlapping the upper axial isolator 64*a* and/or upper axial dampener 71*a* and with the upper axial isolator 64*a* and/or upper axial dampener 71*a* overlapping part of the bottom wall 34 of the inner cup 28. Where equipped with a lower axial isolator 64*b* and/or lower axial dampener 71*b*, the lower axial isolator 64*b* and/or lower axial dampener 71*b* is captured between the bottom wall 36 of the outer cup 30 and the lower coupling flange 72. The brush 20 or 20' is assembled with flange 72 overlapping the lower axial isolator 64*b* and/or lower axial dampener 71*b* and with the lower axial isolator 64*b* and/or lower axial dampener 71*b* overlapping part of the bottom wall 36 of the outer cup 30.

In one such preferred embodiment, the brush 20 or 20' is equipped with both (a) an annular upper axial isolator 64*a* and/or axial dampener 71*a* disposed between (i) the upper brush component retaining flange 70 and (ii) an upper or outer surface the bottom wall 36 of the inner cup 30, and (b) an annular lower axial isolator and/or axial dampener 64*b* disposed between (i) the lower annular coupling flange 72 and (ii) a lower or outer surface of the bottom wall 34 of the outer cup 28. The bottom wall 34 of the inner cup 28 overlaps the hub 38, the hub 38 overlaps the bottom wall 36 of the outer cup 30 and the bottom wall 34 of the inner cup 28, the hub 38, and the bottom wall 36 of the outer cup 30 are disposed between the upper and lower flanges 70, 72 of the shaft 68 of the coupling 58 with the upper axial isolator 64*a* and/or axial dampener 71*a* disposed between upper flange 70 and inner cup bottom wall 34, and the lower axial isolator 64*b* and/or axial dampener 71*b* disposed between lower flange 72 and outer cup bottom wall 36.

Where the rotary cup brush 20 or 20' is equipped with an upper axial isolator 64*a* and/or axial dampener 71*a*, the upper axial isolator 64*a* and/or axial dampener 71*a* is annular and can be in the form of an upper annular or ring-shaped vibration isolating and/or vibration dampening, e.g., vibration absorbing, washer 65, which can be telescoped over part of the shaft 68 and/or seated against or on the cup and hub retainer flange 70 of the shaft 68 of the coupling 48. If desired, the vibration isolating and/or vibration absorbing washer 65 can be integrally formed of the vibration isolating tube 66, like depicted in FIG. 4. If desired, the vibration isolating and/or vibration absorbing washer 65 can be a flange that extends radially outwardly from or adjacent the vibration isolating tube 66. Where equipped with a lower axial isolator and/or axial dampener 64*b*, the lower axial isolator and/or axial dampener 64*b* is annular and can be in the form of a lower annular or ring-shaped vibration isolating and/or vibration dampening, e.g., vibration absorbing, washer 69 which can be telescoped over part of the shaft 68 and/or seated against or on the lower annular coupling flange 72 of the coupling 48. If desired, the vibration isolating and/or vibration absorbing washer 69 can be a flange that extends radially outwardly from or adjacent the vibration isolating tube 66.

If desired, the isolator or dampener of a preferred rotary cup brush 20 or 20' can alternatively be constructed or configured as a tubular isolating or dampening grommet of one-piece construction having (a) a radially outwardly generally annular flange at one end that is or forms the upper axial isolator and/or axial dampener 64*a*, (b) a radially outwardly generally annular flange at an opposite end that is or forms the lower axial isolator and/or axial dampener 64*b*, and (c) a tubular sidewall or grommet body extending therebetween that defines or forms the radial isolating or dampening tube 66. Where provided in the form of a vibrational isolating or vibration dampening grommet, 66 is a tubular radial vibration isolating and/or radial vibration dampening grommet sidewall, 64*a* is an upper axial vibration isolating and/or axial vibration dampening flange extending radially outwardly at or about one end of the radial vibration isolating or radial vibration dampening grommet sidewall at or adjacent one end of the grommet, and 64*b* is a lower axial vibration isolating and/or axial vibration dampening flange extending radially outwardly at or about an opposite end of the radial vibration isolating or radial vibration dampening grommet sidewall at or adjacent an opposite end of the grommet.

With continued reference to FIGS. 1-4, the lower coupling flange 72 of the rotary power tool coupling 58 is disposed between the lower end of the coupling shaft 68 and a coupling head 74 extending axially outwardly from the bottom 34 of the outer cup 28 that is configured for releasable or removable coupling with a hub or spindle of a rotary prime mover that preferably is a grinder, e.g., angle grinder, a rotary drill, or another type of suitable rotary power tool known in the art. As also depicted by FIGS. 1-4, a preferred rotary power tool coupling 58 is elongate and has an internal bore 76, at least part of which is an internally threaded bore 78, such as for threadable coupling or attachment to the rotary spindle or hub of a rotary brush drive, e.g., grinder, drill, etc., and which preferably is an elongate bore, which can and preferably does extend all the way through the elongate generally tubular coupling 58, and which is generally coaxial with a center axis of rotation of the cup brush 20.

In a preferred embodiment, the rotary power tool coupling 58 is formed with a coupling nut assembly 80 formed of a rotary power tool spindle coupling nut 82 disposed exteriorly of the cups 28 and 30 of the cup brush 20 with the nut 82 preferably abutting against the bottom 34 of the outer cup 28 and formed with at least a pair of oppositely disposed tool gripping flats 84 and an internally threaded bore 78 configured to receive an externally threaded spindle or hub of a hand-held rotary power tool used to removably attach the brush 20. In one embodiment, the shaft 68 of the coupling 58 is integrally formed with the nut 82 such that the coupling 58, including the coupling nut assembly 80, is of one-piece, unitary construction that is press-fit through the respective openings 52, 54 and 56 in cups 28, 30 and brush wire hub 38 capturing (a) the upper axial vibration isolator and/or upper axial vibration dampener 64*a* between the upper coupling flange 70 and bottom wall 34 of inner brush cup 28, (b) the radial vibration isolator and/or radial vibration dampener 62 radially between the shaft 68 and inner cup and hub edges defining openings 52, 54 and 56 of cups 28 and 30 and hub 38, and (c) the lower axial vibration isolator and/or upper axial vibration dampener 64*b* between the lower coupling flange 72 and the bottom wall 36 of outer brush cup 30. In another preferred embodiment, the shaft 68 can either be threadably engaged, press-fittingly engaged, snap-fittingly engaged, or otherwise engaged or attached in another manner with the head 74 or nut 82 of the coupling 58.

It is contemplated that a vibration isolating and/or vibration dampening rotary cup brush 20 of the present invention can also be configured with a perforate brush wire hub 38 like that depicted in FIG. 4 which has circumferentially spaced apart holes 40 each having an elongate brush wire tuft 42 extending outwardly therefrom. Each tuft 42 is formed of elongate wires extending through a corresponding hole 40 in the hub 38 which are twisted to form a twisted tuft 42 like the twisted tufts 42 of a vibration isolating twisted knot rotary wire cup brush 20' of the present invention shown in FIG. 3. With continued reference to FIG. 3, a preferred embodiment of a vibration isolating twisted knot cup brush 20' of the present invention has twisted wire tufts 42 each formed of wires that extend through a corresponding hole 40 in the hub 38 and which are twisted in a manner to form a twisted knot (not shown) used to anchor the tuft 42 to the hub 38. Such a vibration isolating twisted knot cup brush 20' of the present invention can have tufts 42 of standard twist knot construction, cable twist knot construction, or even stringer bead twist knot construction with the tufts 42 respectively attached to the hub 38 of the twisted knot cup brush 20' with standard twist knots, cable twist knots, or stringer bead twist knots. Where a vibration isolating twisted knot cup brush 20' of the present invention is formed with brush tufts 42 of twisted tuft or twisted knot construction, each brush tuft 42 preferably is composed of at least a plurality of pairs, i.e., at least three wires, twisted and/or braided together to form the tuft 42. In one preferred embodiment, each tuft 42 of such a vibration isolating cup brush 42 of the present invention is formed of between twenty wires and forty wires, which are twisted together along at least about two-thirds the length of the tuft 42 and which can also be braided. In one preferred embodiment, at least a plurality of tufts of the vibration isolating twisted knot cup brush 20' have tufts 42, and preferably all of the tufts 42 of the cup brush 20' are formed of at least a plurality, preferably at least a plurality of pairs, i.e., at least three, wires each formed of at least a plurality, preferably at least a plurality of pairs, i.e., at least three, strands, which are braided and/or twisted together along substantially the full length of the wire. In one such preferred embodiment, at least a plurality of tufts of the vibration isolating twisted knot cup brush 20' have tufts 42, and preferably all of the tufts 42 of the cup brush 20' are formed of at least a plurality, preferably at least a plurality of pairs, i.e., at least three, wires each formed of at least a plurality, preferably at least a plurality of pairs, i.e., at least three, strands, which are braided and/or twisted together along substantially the full length of the wire, with such multi-stranded wires braided together, twisted together, or braided and twisted together along substantially the entire length of the tuft 42.

A rotary cup brush 20 or 20' of vibration isolating and/or vibration damping construction in accordance with the present invention advantageously significantly reduces the amount of vibration transmitted from the rotating cup brush 20 or 20' during abrasive material removal thereby during surface treatment or surface finishing thereby advantageously reducing, preferably minimizing and/or more preferably helping to prevent occurrence of vibration-induced white finger (VWF) in an operator holding by hand a hand-operated rotary brush drive, such as a grinder, e.g., angle grinder, drill, or the like to which the cup brush 20 or 20' is attached. Such a rotary cup brush 20 or 20' of such axial and/or radial vibration isolating and/or vibration dampening construction also helps reduce vibration transmitted to the hand(s) of an operator manually grasping such a hand-held rotary brush drive to which the cup brush 20 or 20' is mounted thereby advantageously also helping to reduce, preferably minimize, and more preferably help prevent other vibration-induced changes in tendons, muscles, bones, joints and/or the nervous system, collectively known as Hand-Arm Vibration Syndrome (HAVS), in such rotary brush drive, e.g., vibratory tool, operators.

The present invention is directed to a rotary abrasive implement that is a rotary abrasive brush having a hub from which a plurality of pairs of elongate brush wires outwardly extends, at least one three-dimensionally formed plate disposed in operable cooperation with the hub that helps support a portion of at least a plurality of the brush wires, and a vibration isolator disposed in operable cooperation with at least one of the hub and the plate in providing vibration isolation to an operator of a hand-held rotary power tool rotating the rotary brush during contact with a surface being treated or finished causing abrasive material of or from the surface. The vibration isolator preferably is of elastomeric construction. The vibration isolator is made of an elastomeric material. The vibration isolator is made of an elastomer.

The present invention is directed to a rotary abrasive implement that is a rotary abrasive brush having a hub from which a plurality of pairs of elongate brush wires outwardly extends, at least one plate disposed in operable cooperation with the hub, and a vibration isolator disposed in operable cooperation with at least one of the hub and the plate in providing vibration isolation to an operator of a hand-held rotary power tool rotating the rotary brush during contact with a surface being treated or finished causing abrasive material of or from the surface. The vibration isolator is disposed between the hub and the at least one plate. The rotary abrasive implement is a rotary brush that preferably is a rotary cup brush where the at least one plate disposed in operable cooperation with the hub supports or helps support a portion of at least a plurality of the brush wires. The vibration isolator is disposed between the hub and the at least one plate. The at least one plate of the cup brush can be a three-dimensionally contoured or shaped plate that is disposed in operable cooperation with the hub and supports wires of the cup brush. The vibration isolator is disposed between the hub and the at least one plate.

One rotary abrasive implement is a rotary brush having crimped brush wires or brush wires which can be and preferably are twisted and arranged in brush wire tufts which extend outwardly from the hub. The at least one plate disposed in operable cooperation with the hub supports at least a portion of each one of the brush wire tufts. The at least one plate disposed in operable cooperation with the hub is three-dimensionally contoured or shaped and supports at least a portion of each one of the brush wire tufts. The vibration isolator is disposed between the hub and the at least one plate.

Another rotary abrasive implement is a rotary cup brush having crimped brush wires or brush wires which are twisted and arranged in tufts which extend outwardly from the hub. The at least one plate disposed in operable cooperation with the hub supports at least a portion of each one of the brush wire tufts. The at least one plate disposed in operable cooperation with the hub is three-dimensionally contoured or shaped and supports at least a portion of each one of the brush wire tufts. The vibration isolator is disposed between the hub and the at least one plate.

A rotary cup brush equipped with twisted wire brush tufts can be and preferably is attached or anchored to the hub with a twist knot that can be one of a standard twist knot, a cable twist knot, and a stringer bead twist knot. The at least one plate disposed in operable cooperation with the hub supports at least a portion of each one of the brush wire tufts. The at least one plate disposed in operable cooperation with the hub is three-dimensionally contoured or shaped and supports at least a portion of each one of the brush wire tufts. The vibration isolator is disposed between the hub and the at least one plate.

Such a vibration-isolating rotary abrasive implement is a rotary brush that further includes a rotary power tool coupling disposed in operable cooperation with at least one of the hub and the plate, and wherein the vibration isolator vibrationally isolates the rotary power tool coupling from at least one of the hub and the plate. The vibration isolator vibrationally isolates the rotary power tool coupling from at least the hub. The vibration isolator is disposed between the rotary power tool coupling and at least the hub. The vibration isolator spaces at least the hub from the rotary power tool coupling preventing direct contact therebetween. In a preferred embodiment, the vibration isolator isolates the rotary power tool coupling from both the hub and the plate. The vibration isolator preferably is of elastomeric construction. The vibration isolator is made of an elastomeric material. The vibration isolator is made of an elastomer.

In a preferred embodiment, the vibration isolator includes at least one radial vibration isolator. The at least one radial vibration isolator preferably is of elastomeric construction. The at least one radial vibration isolator is made of an elastomeric material. The at least one radial vibration isolator is made of an elastomer. In another preferred embodiment, the vibration isolator includes at least one axial vibration isolator. The at least one axial vibration isolator preferably is of elastomeric construction. The at least one axial vibration isolator is made of an elastomeric material. The at least one axial vibration isolator is made of an elastomer. The vibration isolator includes at least one radial vibration isolator and at least one axial vibration isolator. The at least one radial vibration isolator and the at least one axial vibration isolator are of elastomeric construction. The at least one radial vibration isolator and the at least one axial vibration isolator are made of an elastomeric material. The at least one radial vibration isolator and the at least one axial vibration isolator are made of an elastomer.

Where the rotary brush is a rotary cup brush, the plate preferably is a three-dimensionally formed or three-dimensionally shaped plate. The three-dimensionally formed or three-dimensionally-shaped plate is a cup of the rotary brush cup. A preferred three-dimensionally formed plate of the vibration-isolating cup brush is concave. The concave three-dimensionally formed or three-dimensionally-shaped plate is a cup of the rotary brush cup. Another preferred three-dimensionally formed plate is generally cup-shaped. The cup-shaped three-dimensionally formed or three-dimensionally-shaped plate is a cup of the rotary brush cup. Still another preferred three-dimensionally formed plate is concave and generally cup-shaped. The concave, generally cup-shaped three-dimensionally formed or three-dimensionally-shaped plate is a cup of the rotary brush cup.

A preferred rotary cup brush has a pair of the cups with one of the cups nested within another one of the cups, has the hub disposed or located between the cups, and the vibration isolator is disposed or located between the cups. Another preferred cup brush has a pair of the cups with one of the cups nested within another one of the cups, the hub is disposed or located between the cups, the vibration isolator is disposed or located between the cups, and the vibration isolator is disposed between the rotary power coupling and each one of the cups and the hub.

The vibration isolator includes at least one radial vibration isolator. The at least one radial vibration isolator is disposed or located between the rotary power tool coupling and at least one of the cups. The at least one radial vibration isolator is disposed or located between the rotary power tool coupling and each one of the cups. The at least one radial vibration isolator is disposed or located between the rotary power tool coupling and the hub. The at least one radial vibration isolator is disposed or located between the rotary power tool coupling and at least one of the cups and the hub. The at least one radial vibration isolator is disposed or located between the rotary power tool coupling, each one of the cups, and the hub. The rotary abrasive implement is a rotary brush. The rotary brush is a cup brush.

The vibration isolator includes at least one axial vibration isolator. The at least one axial vibration isolator includes a pair of axial isolators The at least one axial vibration isolator is disposed or located between the rotary power tool coupling and each one of the cups. The at least one axial vibration isolator is disposed or located between the rotary power tool coupling and the hub. The at least one axial vibration isolator is disposed or located between the rotary power tool coupling and at least one of the cups and the hub. The at least one axial vibration isolator is disposed or located between the rotary power tool coupling, each one of the cups, and the hub. The rotary abrasive implement is a rotary brush. The rotary brush is a cup brush.

Where the at least one axial vibration isolator includes a pair of axial isolators, one of the axial vibration isolators is disposed axially between the rotary power tool coupling and one of the cups, and the other one of the axial vibration isolators is disposed axially between the rotary power tool coupling and the other one of the cups. The at least one radial vibration isolator is disposed or located radially between the rotary power tool coupling and at least one of the cups or the hub. The at least one radial vibration isolator is disposed or located radially between the rotary power tool coupling and each cup. The at least one radial vibration isolator is disposed or located radially between the rotary power tool coupling and at least one of the cups and the hub. The at least one radial vibration isolator is disposed or located radially between the rotary power tool coupling, the cups, and the hub. The rotary abrasive implement is a rotary brush. The rotary brush is a cup brush.

The at least one radial vibration isolator includes a tubular radial vibration isolator. The tubular radial vibration isolator is carried by the rotary power tool coupling. The tubular radial vibration isolator is disposed or located between the rotary power tool coupling and the hub. The tubular radial vibration isolator is disposed or located radially between the rotary power tool coupling and the hub. The tubular radial vibration isolator is disposed radially outwardly of the rotary power tool coupling. The tubular radial vibration isolator is disposed radially inwardly of the hub. The tubular radial vibration isolator is disposed radially outwardly of the rotary power tool coupling and radially inwardly of the hub. The tubular radial vibration isolator prevents the rotary power tool coupling from direct contact with the hub. The tubular radial vibration isolator prevents the rotary power tool coupling from direct radial contact with the hub. The rotary abrasive implement is a rotary brush. The rotary brush is a cup brush.

The tubular radial vibration isolator is or includes a vibration isolating tube. The vibration isolating tube is telescoped over at least a portion of the rotary power tool coupling. The vibration isolating tube is telescoped over the rotary power tool coupling. The vibration isolating tube radially vibrationally isolates the hub and the cups from the rotary power tool coupling. The rotary abrasive implement is a rotary brush. The rotary brush is a cup brush.

The at least one axial vibration isolator is formed of or includes a pair of axial vibration isolators axially spaced apart with one of the axial vibration isolators disposed or located axially between the rotary power tool coupling and one of the cups of the rotary cup brush and the other one of the axial vibration isolators disposed or located axially between the rotary power tool coupling and the one of the cups of the rotary cup brush. One of the axial vibration isolators is carried by or disposed at one end of the vibration isolating tube and the other one of the axial vibration isolators is carried by or disposed at an opposite end of the vibration isolating tube. The rotary abrasive implement is a rotary brush. The rotary brush is a cup brush.

The vibration isolator includes at least one radial vibration isolator and at least one axial vibration isolator. The at least one radial vibration isolator and the at least one axial vibration isolator is disposed or located between the rotary power tool coupling and at least one of the cups. The at least one radial vibration isolator and the at least one axial vibration isolator is disposed or located between the rotary power tool coupling and each one of the cups. The at least one radial vibration isolator and the at least one axial vibration isolator is disposed or located between the rotary power tool coupling and the hub. The at least one radial vibration isolator and the at least one axial vibration isolator is disposed or located between the rotary power tool coupling and at least one of the cups and the hub. The at least one radial vibration isolator and the at least one axial vibration isolator is disposed or located between the rotary power tool coupling, each one of the cups, and the hub. The rotary abrasive implement is a rotary brush. The rotary brush is a cup brush.

One such preferred vibration-isolating rotary brush is a vibration-isolating cup brush having the at least one plate that is a three-dimensionally formed plate further includes a rotary power tool coupling disposed in operable cooperation with at least one of the hub and the three-dimensionally formed plate, and wherein the vibration isolator vibrationally isolates the rotary power tool coupling from at least one of the hub and the three-dimensionally formed plate. The vibration isolator vibrationally isolates the rotary power tool coupling from at least the hub. The vibration isolator is disposed between the rotary power tool coupling and at least the hub. The vibration isolator spaces at least the hub from the rotary power tool coupling preventing direct contact therebetween. In a preferred embodiment, the vibration isolator isolates the rotary power tool coupling from both the hub and the three-dimensionally formed plate. Where the rotary brush is a rotary cup brush and the plate preferably is a three-dimensionally formed or three-dimensionally shaped plate. The three-dimensionally formed or three-dimensionally-shaped plate is a cup of the rotary brush cup. A preferred three-dimensionally formed plate of the vibration-isolating cup brush is concave. The concave three-dimensionally formed or three-dimensionally-shaped plate is a cup of the rotary brush cup. Another preferred three-dimensionally formed plate is generally cup-shaped. The cup-shaped three-dimensionally formed or three-dimensionally-shaped plate is a cup of the rotary brush cup. Still another preferred three-dimensionally formed plate is concave and generally cup-shaped. The concave, generally cup-shaped three-dimensionally formed or three-dimensionally-shaped plate is a cup of the rotary brush cup. A preferred rotary cup brush has a pair of the cups with one of the cups nested within another one of the cups, has the hub disposed or located between the cups, and the vibration isolator is disposed or located between the cups. Another preferred cup brush has a pair of the cups with one of the cups nested within another one of the cups, the hub is disposed or located between the cups, the vibration isolator is disposed or located between the cups, and the vibration isolator is disposed between the rotary power coupling and each one of the cups and the hub. The rotary abrasive implement is a rotary brush. The rotary brush is a cup brush.

The at least one axial vibration isolator is formed of or includes a pair of axial vibration isolators axially spaced apart with one of the axial vibration isolators disposed or located axially between the rotary power tool coupling and one of the cups of the rotary cup brush and the other one of the axial vibration isolators disposed or located axially between the rotary power tool coupling and the one of the cups of the rotary cup brush. One of the axial vibration isolators is carried by or disposed at one end of the vibration isolating tube and the other one of the axial vibration isolators is carried by or disposed at an opposite end of the vibration isolating tube. The rotary abrasive implement is a rotary brush. The rotary brush is a cup brush.

In a preferred embodiment, the vibration isolator is a vibration dampener. Each axial vibration isolator is, includes, defines or forms a vibration dampener. Each radial vibration isolator is, includes, defines or forms a vibration dampener. Where a radial vibration isolator is in the form of a vibration isolating tube, the vibration isolating tube is, includes, defines or forms a vibration dampener. The rotary abrasive implement is a rotary brush. The rotary brush is a cup brush.

The present invention is directed to a rotary brush that includes (a) a hub from which a plurality of pairs of elongate brush wires or brush wire tufts outwardly extend (b) at least one three-dimensionally formed plate disposed in operable cooperation with the hub that supports or helps support a portion of at least a plurality of the brush wires or brush wire tufts; (c) a coupling operatively connected to the hub and the at least one three-dimensionally formed plate in forming a rotary brush assembly, and (d) a vibration isolator vibrationally isolating the coupling from the hub. The vibration isolator is or includes an axial vibration isolator that axially isolates the coupling from the hub, and a radial vibration isolator that radially isolates the coupling from the hub. The radial vibration isolator is tubular and carried by part of the coupling (i) disposed or located radially outwardly of the coupling, and (ii) disposed or located radially inwardly of the hub. The radial vibration isolator is tubular and carried by part of the coupling disposed or located radially outwardly of the coupling and radially inwardly of the hub.

The axial vibration isolator is disposed or located between the coupling and the at least one three-dimensionally formed plate that is operatively connected to the hub by the coupling. The at least one three-dimensionally formed plate is or includes a generally concave generally circular rotary brush cup along with brush wires extend from the hub outwardly thereof, and wherein the rotary brush is a rotary cup brush. The axial vibration isolator is disposed axially between the rotary brush cup and an axial surface of the coupling disposed adjacent the rotary brush cup. The axial vibration isolator prevents direct axial contact between the axial surface of the coupling and the rotary brush cup. The axial vibration isolator is annular.

The coupling includes an elongate shaft, the at least one three-dimensionally formed plate is formed of or includes a pair of generally coaxially nested concave generally circular rotary brush cups each having a generally circular cup bottom wall with a coupling opening formed therein, and a cup sidewall extending radially and axially outwardly from the bottom wall about the periphery of the bottom wall, and the hub is disposed or located interjacent the bottom walls of the rotary brush cups, the hub having a coupling opening formed therein generally coaxial with the coupling openings formed in the bottom walls of the respective rotary brush cups. The vibration isolator is or includes a radial vibration isolator carried by at least a portion of the shaft, the tubular radial vibration isolator is disposed or located radially outwardly of the shaft and radially inwardly of the cups and the hub. The radial vibration isolator is disposed between radially opposed surfaces of the shaft and the plates and hub. The radial vibration isolator is configured to radially space the shaft from the plates and hub preventing direct contact therebetween thereby preventing transmission of radial vibration from one of the hub and plates to the shaft and to the rotary tool removably coupled by the shaft to the rotary brush.

The radial vibration isolator is or includes radial vibration isolating tube that is received over part of the shaft. The radial vibration isolating tube is telescoped of part of the shaft between the flanges of the shaft. The radial vibration isolating tube extends between the flanges from one of the flanges to the other one of the flanges of the shaft of the rotary coupling.

The vibration isolator further includes a pair of spaced apart axial vibration isolators with (a) one of the axial vibration isolators disposed between (i) an upper rotary brush assembly coupling flange of the coupling disposed in operable cooperation with one of the rotary brush cups, and (ii) the one of the rotary brush cups, and (b) the other one of the axial vibration isolators disposed between (i) a lower rotary brush assembly coupling flange of the coupling disposed in operable cooperation with the other one of the rotary brush cups, and (ii) the other one of the rotary brush cups. The tubular radial vibration isolator is or includes a radial vibration isolating tube, and the pair of axial vibration isolators form or includes annular vibration isolators through which part of the shaft extends with one of the annular vibration isolators disposed or located between the upper rotary brush assembly coupling flange and the bottom wall of the one of the rotary brush cups, and the other one of the annular vibration isolators disposed or located between the lower rotary brush assembly coupling flange and the bottom wall of the other one of the rotary brush cups.

The coupling is or defines a rotary power tool coupling. The coupling further includes an internally threaded nut disposed or located at an opposite end of the shaft which is in turn disposed or located against or adjacent the bottom wall of the other one of the rotary brush cups.

Understandably, the present invention has been described above in terms of one or more preferred embodiments and methods. It is recognized that various alternatives and modifications can be made to these embodiments and methods that are within the scope of the present invention. It is also to be understood that, although the foregoing description and drawings describe and illustrate in detail one or more preferred embodiments of the present invention, to those skilled in the art to which the present invention relates, the present disclosure will suggest many modifications and constructions as well as widely differing embodiments and applications without thereby departing from the spirit and scope of the invention. The present invention, therefore, is intended to be limited only by the scope of the appended claims.

It is claimed:

1. A rotary brush comprising:

(a) a hub from which brush wires outwardly extend;

(b) at least one plate disposed in operable cooperation with the hub;

(c) a rotary tool coupling operatively connected to the hub and the plate; and (d) a vibration isolator disposed between the rotary tool coupling and the hub and configured to isolate the rotatory tool coupling from axial and/or radial vibrations created by the at least one plate and/or the hub.

2. The rotary brush of claim 1, wherein the vibration isolator is non-metallic and compressible.

3. The rotary brush of claim 1, wherein the vibration isolator isolates radial vibration.

4. The rotary brush of claim 3, wherein the vibration isolator isolates axial vibration.

5. The rotary brush of claim 1, wherein the vibration isolator is comprised of a tubular vibration isolator extending in an axial direction relative to an axis of rotation of the brush about which the hub, at least one plate, and rotary tool coupling rotate.

6. The rotary brush of claim 5, wherein the tubular vibration isolator comprises a vibration isolating tube that is generally cylindrical and telescopes over at least a portion of the rotary tool coupling.

7. The rotary brush of claim 1, wherein the vibration isolator is annular and telescopically received on the tool coupling and disposed between an axial surface of the tool coupling and an axial surface of the at least one plate.

8. A rotary brush comprising:

(a) a hub from which brush wires outwardly extend;

(b) at least one plate disposed in operable cooperation with the hub;

(c) a rotary tool coupling operatively connected to the hub and the plate;

(d) a vibration isolator vibrationally isolating the coupling from the hub;

wherein the rotary coupling comprises a coupling shaft having a pair of flanges between which the at least one plate and hub are captured, and wherein the vibration isolator comprises (a) a radial vibration isolator disposed between (i) the shaft, and (ii) the hub, and (b) an axial vibration isolator disposed between (i) one of the flanges and the at least one plate; and wherein the radial vibration isolator comprises a tube telescoped over part of the coupling shaft between the flanges, and wherein the axial vibration isolator comprises an annular washer received on the shaft and disposed between one of the flanges and at least one plate.

9. The rotary brush of claim 8, wherein the radial vibration isolator comprises an elongate vibration isolating tube telescoped over part of the coupling shaft between the flanges locating the vibration isolating tube radially between (i) the shaft, and (ii) the hub and the at least one plate, and wherein the axial vibration isolator comprises an annular washer received on the shaft and located axially between one of the flanges and the at least one plate.

10. The rotary brush of claim 9, wherein vibration isolating tube comprises a vibration absorbing dampener, and wherein the annular washer extends radially outwardly from the vibration isolating tube.

11. The rotary brush of claim 8, wherein the at least one plate comprises a pair of the plates, wherein the hub is sandwiched between the pair of the plates, and wherein there is a plurality of axial vibration isolators with one of the axial vibration isolators disposed between one of the flanges and one of the plates and another one of the axial vibration isolators disposed between the other one of the flanges and the other one of the plates.

12. The rotary brush of claim 11, wherein the radial vibration isolator comprises an elongate vibration isolating tube telescoped over part of the coupling shaft between the flanges locating the vibration isolating tube radially between (i) the shaft, and (ii) the hub and the pair of plates sandwiching the hub, and wherein each axial vibration isolator comprises an annular washer received on the shaft and located axially between each one of the flanges and a corresponding one of the plates.

13. The rotary brush of claim 12, wherein the radial vibration isolator and each axial vibration isolator are comprised of an elastomer or an elastomeric material.

14. The rotary brush of claim 12, wherein the plates each comprise a generally convex three-dimensionally contoured cup, wherein one of the cups is generally coaxial with the hub and the other one of the cups, wherein one of the cups is nested within the other one of the cups, and wherein the rotary brush is a cup brush.

15. A rotary brush comprising:

(a) a hub from which brush wires outwardly extend;

(b) a pair of plates sandwiching the hub therebetween;

(c) a rotary tool coupling operatively connected to the hub and the plate; and (d) a vibration isolator vibrationally isolating (i) the coupling from (ii) the hub and the plates wherein vibration isolator comprises (a) a radial vibration isolator disposed radially between (i) the rotary tool coupling, and (ii) the hub and the plates, and (b) a pair of axial vibration isolators disposed axially between the rotary tool coupling, and (ii) each one of the plates; and wherein the rotary tool coupling comprises an elongate shaft carrying the hub and both plates, wherein the radial vibration isolator comprises an elongate vibration isolating tube telescoped over a portion of the shaft between the flanges disposing the vibration isolating tube between (i) the shaft, and (ii) the hub and the plates, and wherein each axial vibration isolator comprises an annular washer disposed between each one of the plates and a corresponding adjacent one of the flanges of the shaft.

16. The rotary brush of claim 15, wherein the plates each comprise a generally convex three-dimensionally contoured cup, wherein one of the cups is generally coaxial with the hub and the other one of the cups, wherein one of the cups is nested within the other one of the cups, and wherein the rotary brush is a cup brush.

* * * * *